US010753109B2

(12) United States Patent
Amend

(10) Patent No.: US 10,753,109 B2
(45) Date of Patent: Aug. 25, 2020

(54) CONCRETE FORM TIE, AND CONCRETE FORMWORK COMPRISING SAME

(71) Applicant: Victor Amend, Toronto (CA)

(72) Inventor: Victor Amend, Toronto (CA)

( * ) Notice: Subject to any disclaimer, the term of this patent is extended or adjusted under 35 U.S.C. 154(b) by 0 days.

(21) Appl. No.: 16/109,469

(22) Filed: Aug. 22, 2018

(65) Prior Publication Data

US 2020/0063451 A1 Feb. 27, 2020

(51) Int. Cl.

| | |
|---|---|
| ***E04G 17/07*** | (2006.01) |
| ***E04G 9/02*** | (2006.01) |
| ***E04B 2/84*** | (2006.01) |
| ***E04B 1/16*** | (2006.01) |
| ***E04G 11/08*** | (2006.01) |
| ***E04G 17/075*** | (2006.01) |
| *E04G 17/06* | (2006.01) |

(52) U.S. Cl.

CPC ..... *E04G 17/0758* (2013.01); *E04B 1/161* (2013.01); *E04B 2/84* (2013.01); *E04G 9/02* (2013.01); *E04G 11/08* (2013.01); *E04G 2017/0638* (2013.01)

(58) Field of Classification Search

CPC ..... E04G 17/0758; E04G 9/02; E04G 11/08; E04G 2017/0638; E04B 1/161; E04B 2/84

USPC ..... 52/742.14

See application file for complete search history.

(56) References Cited

U.S. PATENT DOCUMENTS

| | | | | |
|---|---|---|---|---|
| 5,246,640 | A * | 9/1993 | Bryant | E04G 11/10 249/19 |
| 5,701,710 | A | 12/1997 | Tremelling | |
| 5,709,060 | A | 1/1998 | Vaughan et al. | |
| 5,735,093 | A * | 4/1998 | Grutsch | E04B 2/8635 52/309.11 |
| 6,230,462 | B1 * | 5/2001 | Beliveau | E04B 2/8617 52/426 |
| 6,314,694 | B1 | 11/2001 | Cooper et al. | |
| 7,059,577 | B1 | 6/2006 | Burgett | |
| 7,082,731 | B2 * | 8/2006 | Patz | E04B 2/8635 52/309.11 |
| 9,091,089 | B2 * | 7/2015 | Pfeiffer | E04G 17/12 |
| 9,121,166 | B2 | 9/2015 | Amend | |
| 9,333,672 | B1 * | 5/2016 | Gavish | B28B 7/248 |
| 10,378,204 | B2 * | 8/2019 | Gosain | E04B 2/8652 |
| 10,487,501 | B2 * | 11/2019 | Howorth | E04B 2/8641 |
| 2001/0029717 | A1 * | 10/2001 | Spakousky | E04B 2/8617 52/405.4 |
| 2003/0213198 | A1 * | 11/2003 | Bentley | E04B 2/8617 52/415 |
| 2007/0094973 | A1 * | 5/2007 | Zhu | E04B 1/161 52/415 |
| 2009/0013629 | A1 * | 1/2009 | Boeshart | E04B 2/8617 52/426 |
| 2010/0251651 | A1 * | 10/2010 | Mahe | E04B 2/8652 52/426 |

(Continued)

*Primary Examiner* — Jeanette E Chapman

(74) *Attorney, Agent, or Firm* — Fay Sharpe LLP

(57) ABSTRACT

A tie for a concrete formwork comprises: a tie anchor configured to be embedded in a block of insulating material, the tie anchor having a first connecting feature accessible from a concrete-facing surface of the block; and a tie member having a second connecting feature configured to connect to the first connecting feature of the tie anchor. The tie member has at least one connector for connecting to an abutting tie member.

16 Claims, 22 Drawing Sheets

(56) References Cited

U.S. PATENT DOCUMENTS

| | | | | |
|---|---|---|---|---|
| 2013/0074432 | A1* | 3/2013 | Ciuperca | E04B 1/21 52/309.4 |
| 2014/0260055 | A1* | 9/2014 | Pfeiffer | E04G 17/12 52/582.1 |
| 2017/0254072 | A1* | 9/2017 | Howorth | E04B 2/86 |

* cited by examiner

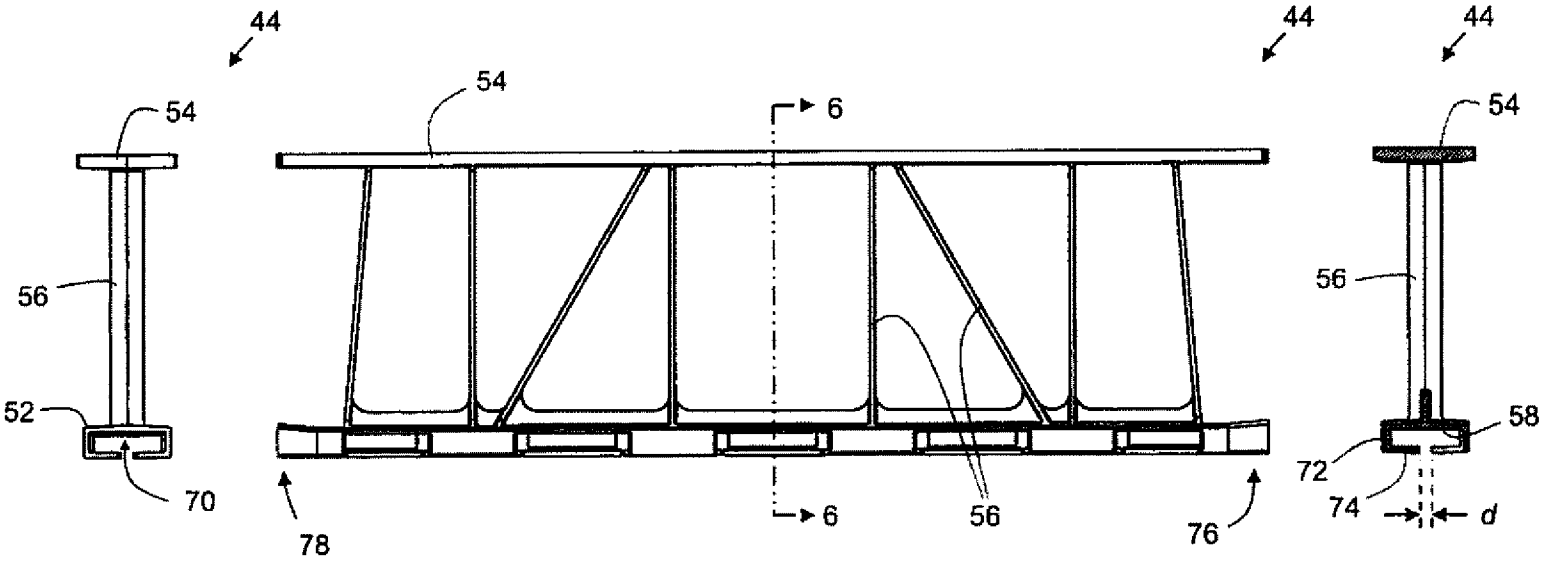
Figure 4
Figure 5
Figure 6
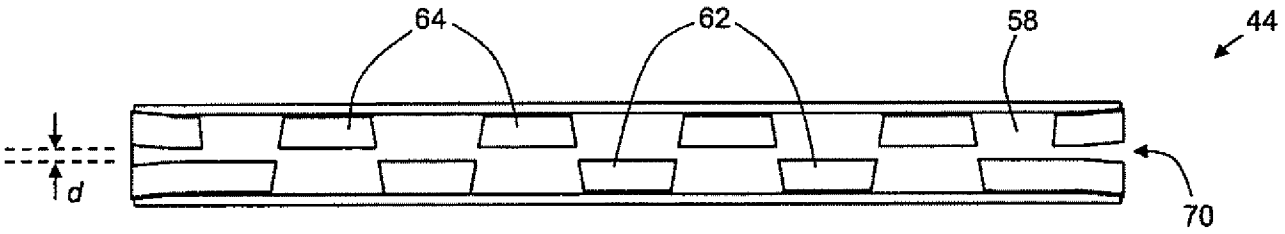
Figure 7

CONCRETE FORM TIE, AND CONCRETE FORMWORK COMPRISING SAME

FIELD

The subject application generally relates to forms for concrete walls and in particular, to a concrete form tie and a concrete formwork comprising the same.

BACKGROUND

Conventional forms for forming walls from pourable building material such as concrete consists of two opposed panels, typically fabricated of plywood, that are connected by a rod, trusswork or other connecting structure. More recently, it has become desirable to use insulating material such as expanded polystyrene (EPS) for the form, in order to provide thermal and acoustic insulation to the finished concrete wall. In certain applications, particularly those in which it is desired to utilize the ability of the concrete to retain heat for thermal stabilization, it is desirable to employ forms with insulating material on only one side. The other side of the form, which is typically a sheet of plywood or other material, may or may not be removed after full or partial setting of the concrete.

Concrete formworks comprising insulating material have been previously described. For example, U.S. Pat. No. 5,701,710 to Tremelling describes a freestanding form module for receiving flowable materials that includes a pair of form members, preferably made of styrofoam, joined together by molded plastic rib members. The rib members may be monolithic or formed from plural components. Bearing plates and stabilizing plates are employed to support forces applied to the form module.

U.S. Pat. No. 5,709,060 to Vaughan et al. describes a form tie for joining sidewalls of a polymeric concrete form that comprises a pair of end trusses with an intermediate web truss. Each end truss comprises an interior vertical strut and a longer exterior strut with interior and exterior pairs of horizontal struts extending therebetween. Upper and lower rectangular trusses and an intermediate truss are formed within each truss and rigidified by diagonal struts extending between the ends of the exterior vertical strut and interior vertical strut. The exterior struts of each end truss are coplanar with the exterior sidewall surface with the interior strut of each end truss being coplanar with the interior sidewall surface. The coplanar relationship of the struts serve as a visual gauge that the form with tie has been properly manufactured and assures that the end trusses extend throughout the width of each sidewall. End ties having a height of one-half of the form sidewall are extended between the sidewalls at the ends of each form. The end ties of adjacent forms are vertically offset to enhance concrete flow therebetween. During transport and use the trusses resist the presence of compression, tension, twisting and other forces acting on the forms so as to maintain the desired spatial relationship between the forms. A seat for horizontal rebar is found with each form tie.

U.S. Pat. No. 6,314,694 to Cooper et al. describes one-sided, insulated formwork used in the construction of walls from pourable building material, such as concrete, including an insulating panel connectable to a removable panel by a connecting structure, which may include a permanent reinforcement embedded in the insulating panel. The connecting structure may have a tie removably attachable to the reinforcement, or the reinforcement and tie may constitute a monolithic structure. The tie may be asymmetric in shape to facilitate distribution of loads across the insulating panel, detachment of the removable panel, and enhance the structural integrity of the finished wall.

U.S. Pat. No. 7,059,577 to Burgett describes a method and system for installing an insulated concrete wall includes insulation panels placed in an upright manner. Generally T-shaped wall studs are placed next to the insulation panels such that the front section of the wall stud is on the outside of the insulation panels and an anchoring section of the wall stud extends beyond the insulation panels into the gap into which concrete will later be poured. Concrete pouring forms are placed so as to render the gap into which concrete will be poured a desired thickness. The wall stud may also include slots for receiving cross-ties that secure the concrete pouring forms in proper position and retaining nubs that prevent the insulation panels from floating when concrete is poured. Concrete is then poured into the gap, surrounding the anchoring section the T-shaped wall stud.

U.S. Pat. No. 9,121,166 to Amend describes a panel for a building form made of insulating material such as polystyrene that is integrated with a reinforcing member for enabling the panel to resist deformation due to forces applied against its concrete-facing surface. The reinforcing member may be made of a plastic material such as polypropylene or high-impact polystyrene.

U.S. Patent Application Publication No. 2001/029717 to Spakousky describes a composite modular building block with a connective structure between the outer and inner wall. The inner and outer walls of the composite modular block units may be made of cement, clay brick, or similar materials. The connective structure is made of a different material than the walls of the composite block and may be formed per the requirements of each block. In one embodiment, the connective structure may comprise two or more individual connective struts connecting an outer and an inner wall of a modular block. A panel member cooperating with the struts may be inserted between the outer and inner walls to form two separate cavities between the blocks when these are assembled into a wall.

Improvements are generally desired. It is therefore at least an object to provide a novel concrete form tie and a novel concrete formwork comprising the same same.

SUMMARY

It should be appreciated that this summary is provided to introduce a selection of concepts in a simplified form that are further described below in the detailed description. This summary is not intended to be used to limit the scope of the claimed subject matter.

Accordingly, in one aspect, there is provided a tie for a concrete formwork, the tie comprising: a tie anchor configured to be embedded in a block of insulating material, the tie anchor having a first connecting feature accessible from a concrete-facing surface of the block; and a tie member having a second connecting feature configured to connect to the first connecting feature of the tie anchor, the tie member having at least one connector for connecting to an abutting tie member.

The first connector may comprise features defining a channel that is sized to receive the second connector. The features may comprise a base plate and a plurality of angled tabs extending therefrom and defining the channel. The second connector may comprise features configured to be received in the first connector. The features may comprise a rail including one or more longitudinal tabs.

The first connector may comprise a longitudinal rib having features defining a channel that is sized to receive the second connector. The features may comprise a base plate and a plurality of angled tabs extending therefrom and defining the channel. The second connector may comprise features configured to accommodate at least a portion of the first connector. These features may comprise a longitudinal guide defining a longitudinal channel that is sized to accommodate at least a portion of the first connector. The longitudinal guide may have a generally "C-shaped" section along its length, defining the channel. The longitudinal guide may comprise a series of angled tabs extending from a longitudinal baseplate, defining the channel.

The tie member may further comprise a panel fastening plate defining an elongate panel fastening surface; and a central web connecting the panel fastening plate and the second connecting feature. The tie may further comprise flanges extending laterally from the panel fastening plate and defining a portion of the panel fastening surface. The panel fastening surface may extend the length of the panel fastening plate. The web may have a linking feature formed in an edge thereof, the linking feature being sized to engage a connecting rod for linking the tie member to an adjacent tie member. The linking feature may be a notch formed in the edge of the web, the notch being sized to receive the connecting rod. The linking feature may be a pin formed in the edge of the web, the pin being sized to engage a bore formed in the connecting rod. The at least one connector may comprise a connector at each longitudinal end of the panel fastening plate. The at least one connector may be configured to prevent relative lateral movement of the abutting tie members. The at least one connector may comprise a connector at each end of the second connecting feature. The at least one connector may be configured to prevent separation of the abutting tie members in a longitudinal direction.

In another aspect, there is provided a concrete formwork, comprising: a plurality of blocks of insulating material arranged to define a side of the formwork, each block comprising at least two tie anchors embedded therein, each tie anchor having a first connecting feature accessible from a concrete-facing surface of the block; a plurality of tie members, each tie member having a second connecting feature connected to the first connecting feature of the tie anchor; a connecting rod seated horizontally on two or more adjacent tie members, the connecting rod linking the two or more tie members; and a panel fastened to the tie members, the panel and the blocks defining a volume into which concrete is to be poured.

The panel may be spaced from ends of the tie members by a plurality of spacers. The panel may be fastened to the tie members by fasteners extending through the spacers.

In another aspect, there is provided a method of constructing a concrete wall and a concrete floor slab of a building, comprising: arranging a plurality of blocks of insulating material, each block comprising at least two tie anchors embedded therein, each tie anchor having a first connecting feature on a concrete-facing surface of the block; connecting tie members to the tie anchors, each tie member having second connecting feature matingly engaging the first connecting feature of a respective one of the tie anchors; fastening an insulating panel to the tie members, the insulating panel being fabricated of insulating material; pouring concrete into a volume defined by the blocks and the insulating panel to form the concrete wall; removing the panel from the concrete wall after the concrete has set; laying the insulating panel on ground; and pouring concrete onto the insulating panel to form the concrete floor slab.

The concrete wall may be formed on a concrete footing.

The laying may further comprise: laying a vapour barrier on the ground; and laying the insulating panel on the vapour barrier.

BRIEF DESCRIPTION OF THE DRAWINGS

Embodiments will now be described more fully with reference to the accompanying drawings in which:

FIG. 4 is an end view of the tie anchor of FIG. 3;

FIG. 5 is a side view of the tie anchor of FIG. 3;

FIG. 6 is a sectional view of the tie anchor of FIG. 5, taken along the indicated section line;

FIG. 7 is a front view of the tie anchor of FIG. 3;

DETAILED DESCRIPTION OF EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Figure 1:
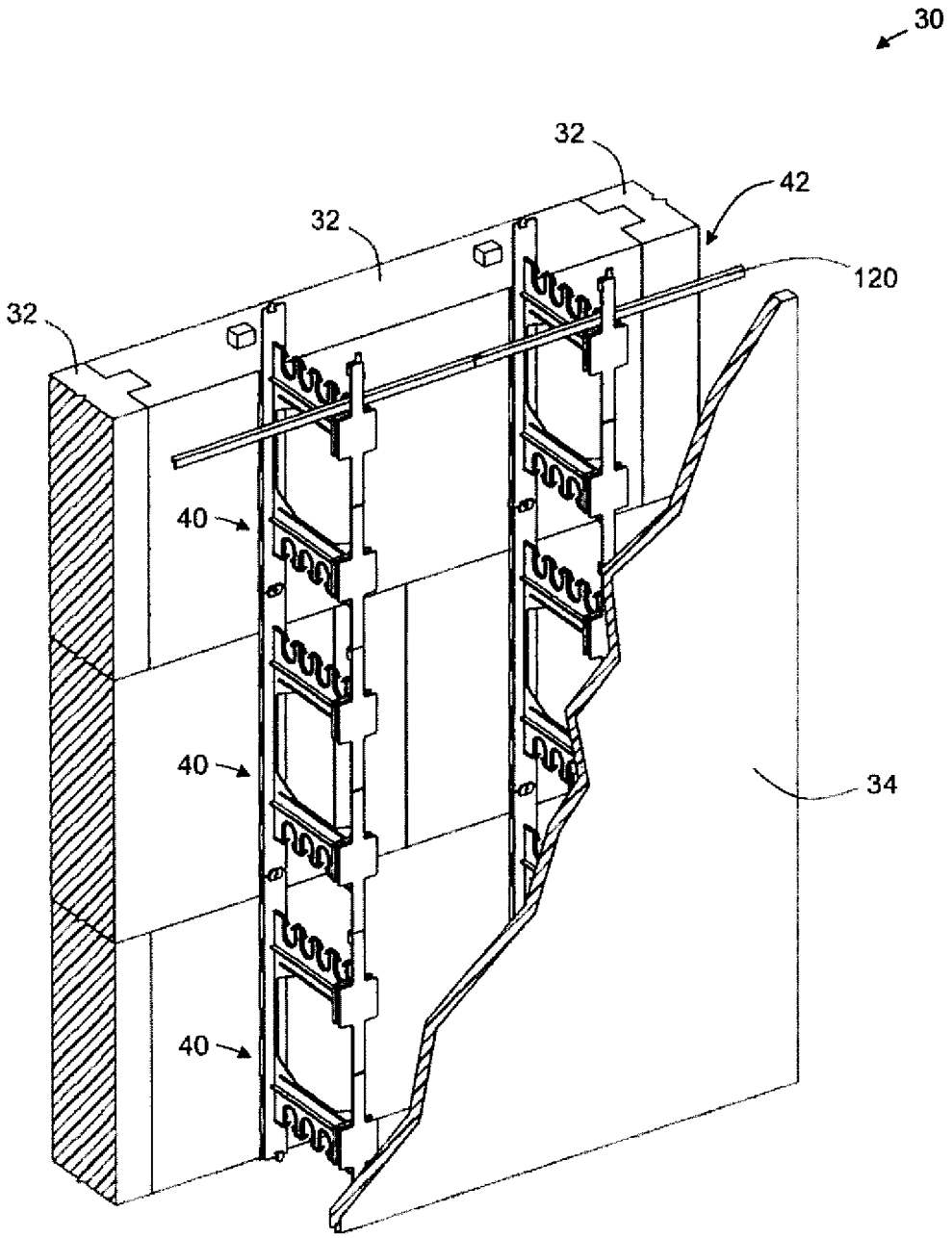
FIG. 1 is a perspective view of a concrete formwork.

Turning now to FIG. 1, a portion of an assembled concrete formwork is shown and is generally indicated by reference numeral 30. Concrete formwork 30 is configured to serve as a mold into which concrete (not shown) is poured to form a concrete wall during construction of a building. The building may be a residential building, such as a house, and the concrete wall may be a concrete foundation wall, for example.

Concrete formwork 30 comprises a plurality of blocks 32 fabricated of an insulating material, a plurality of panels 34, and a plurality of ties 40 connecting the blocks 32 and the panels 34. When connected by the ties 40, the blocks 32 and the panels 34 define a volume 42 into which the concrete is to be poured. Each block 32 is fabricated of expanded polystyrene (EPS) foam by molding. The panels 34 may be fabricated of EPS foam, or of a rigid sheet material such as plywood, oriented strand board (OSB), and the like.

Figure 2:
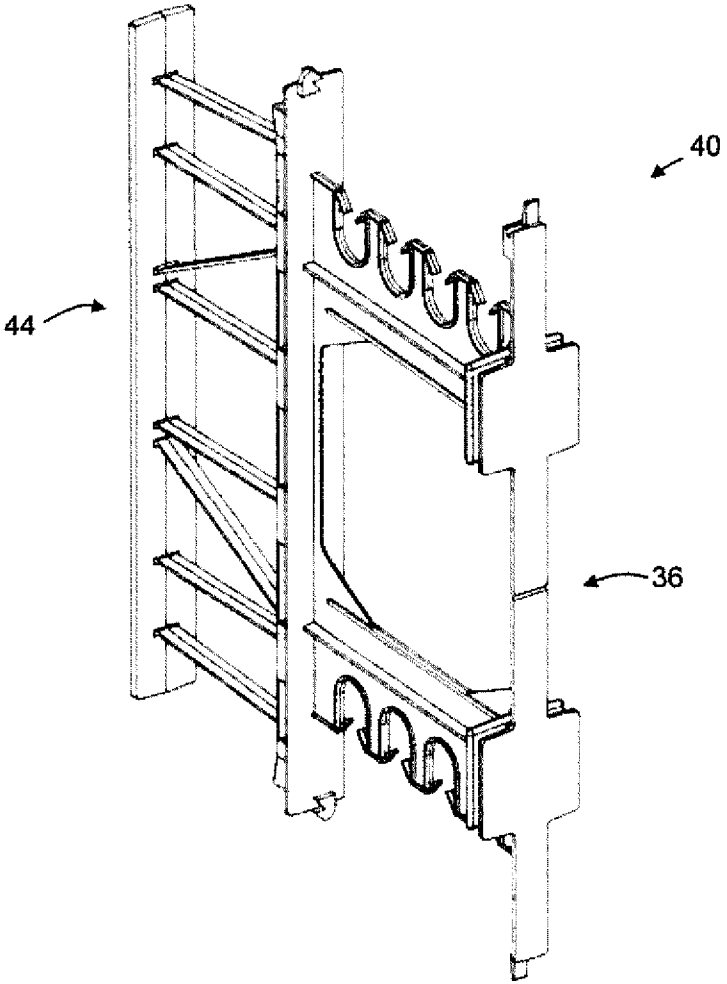
FIG. 2 is a perspective view of a tie forming part of the concrete formwork of FIG. 1.
Figure 3:
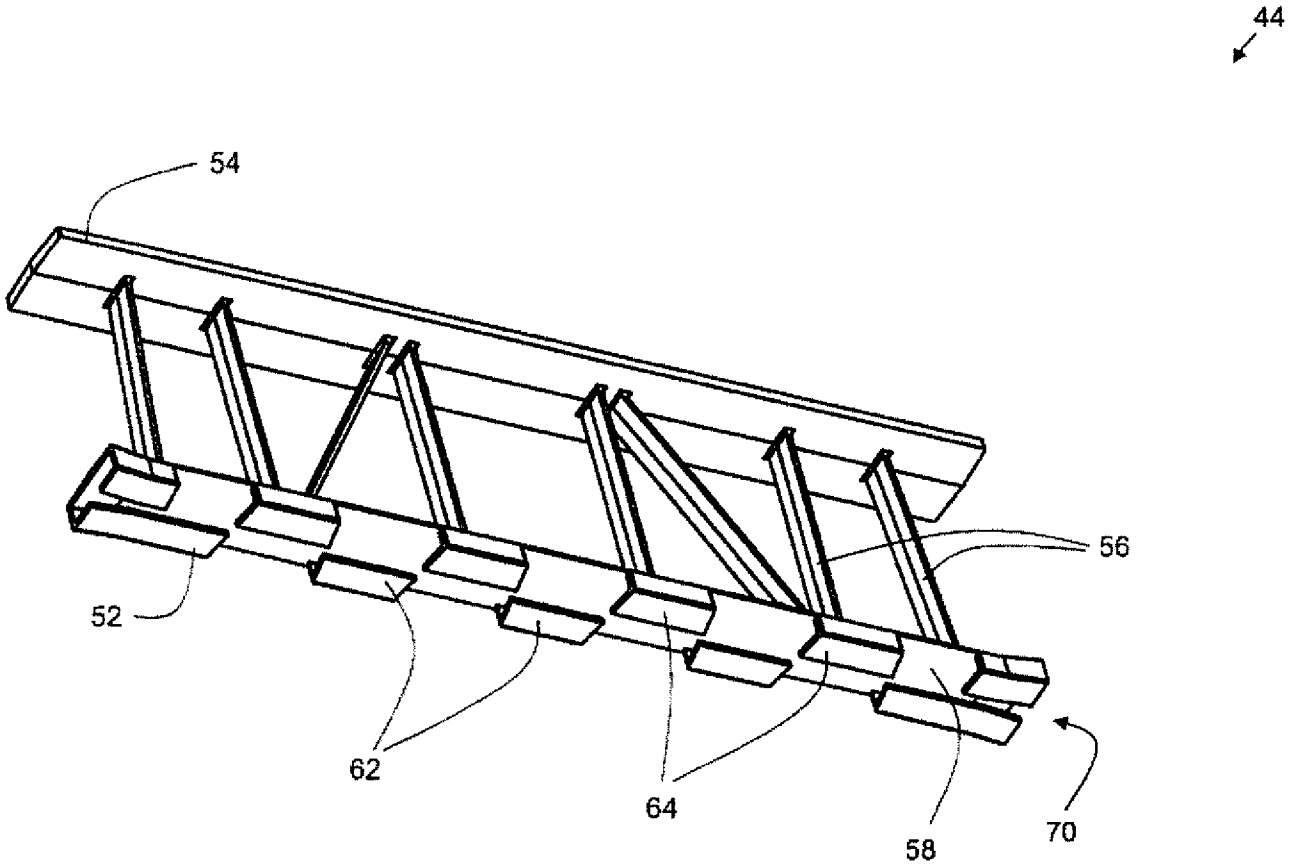
FIG. 3 is a perspective view of a tie anchor forming part of the tie of FIG. 2.
Figure 8:
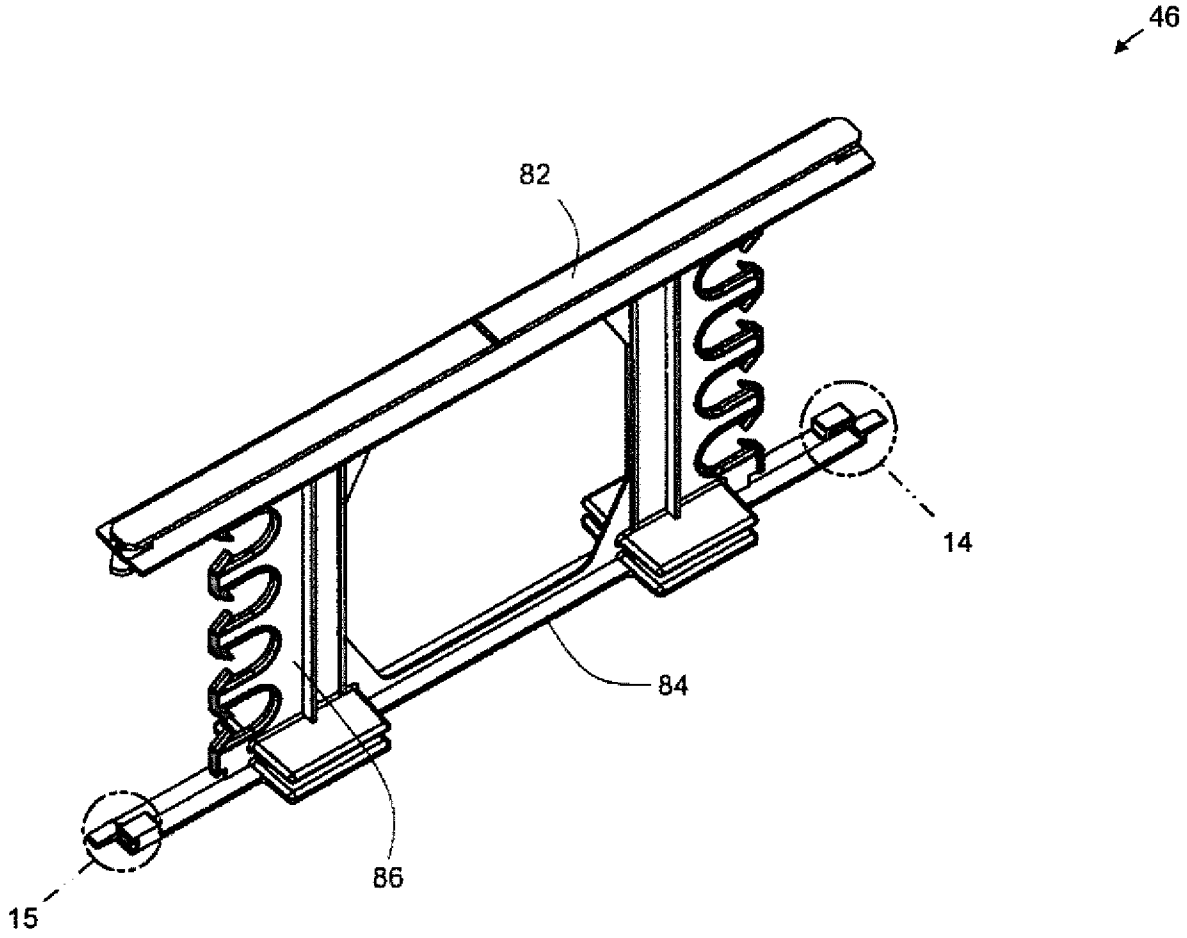
FIG. 8 is a perspective view of a tie member forming part of the tie of FIG. 2.
Figure 9:
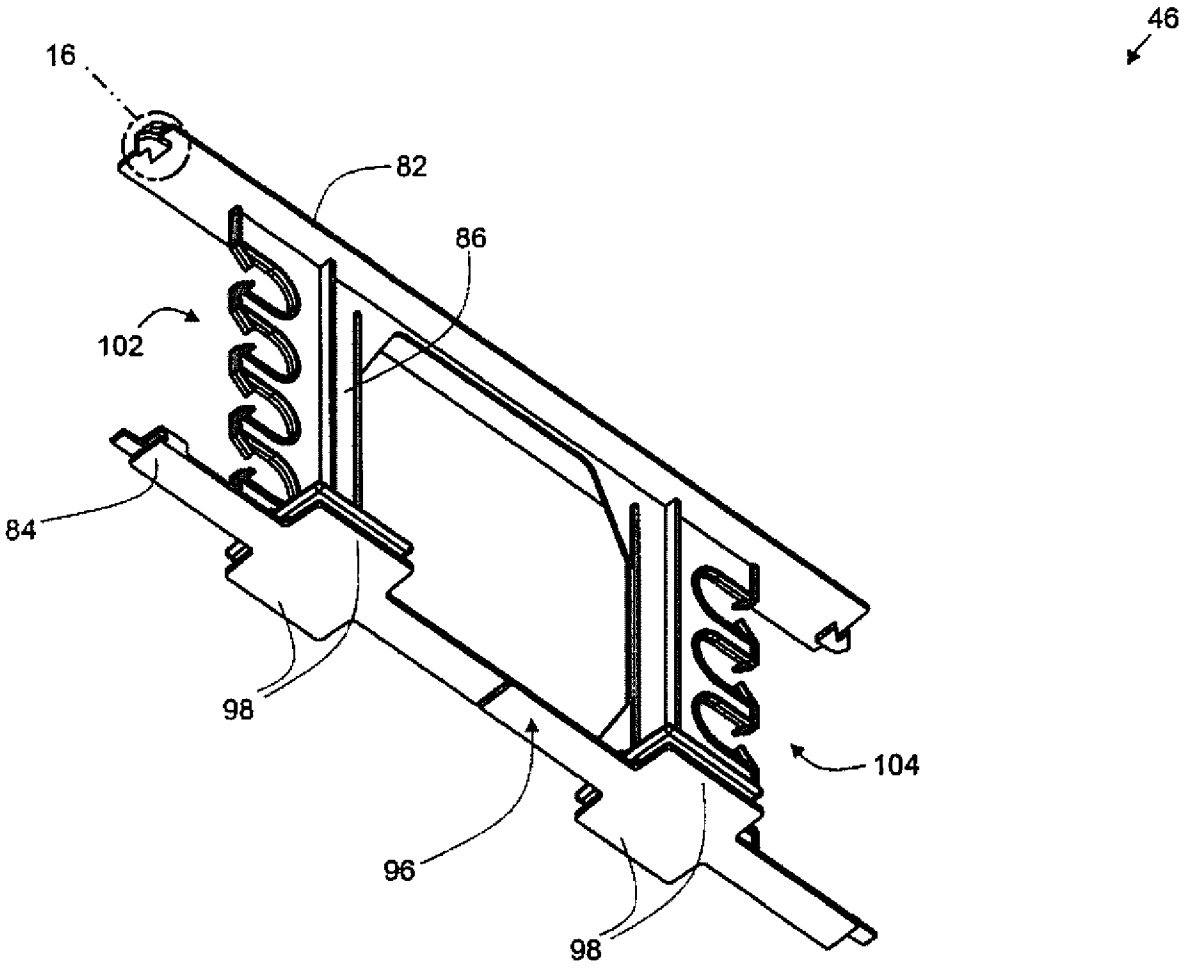
FIG. 9 is another perspective view of the tie member of FIG. 8.
Figure 11:
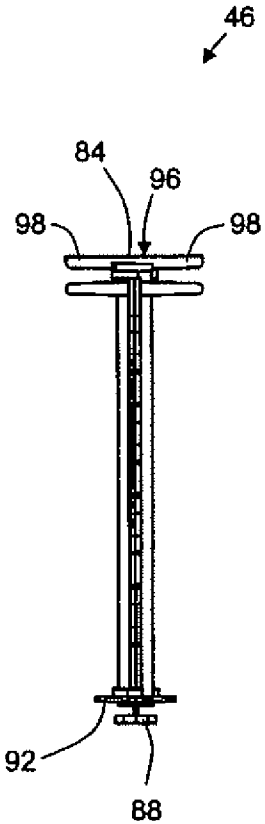
FIG. 11 is an end view of the tie member of FIG. 8.
Figure 10:
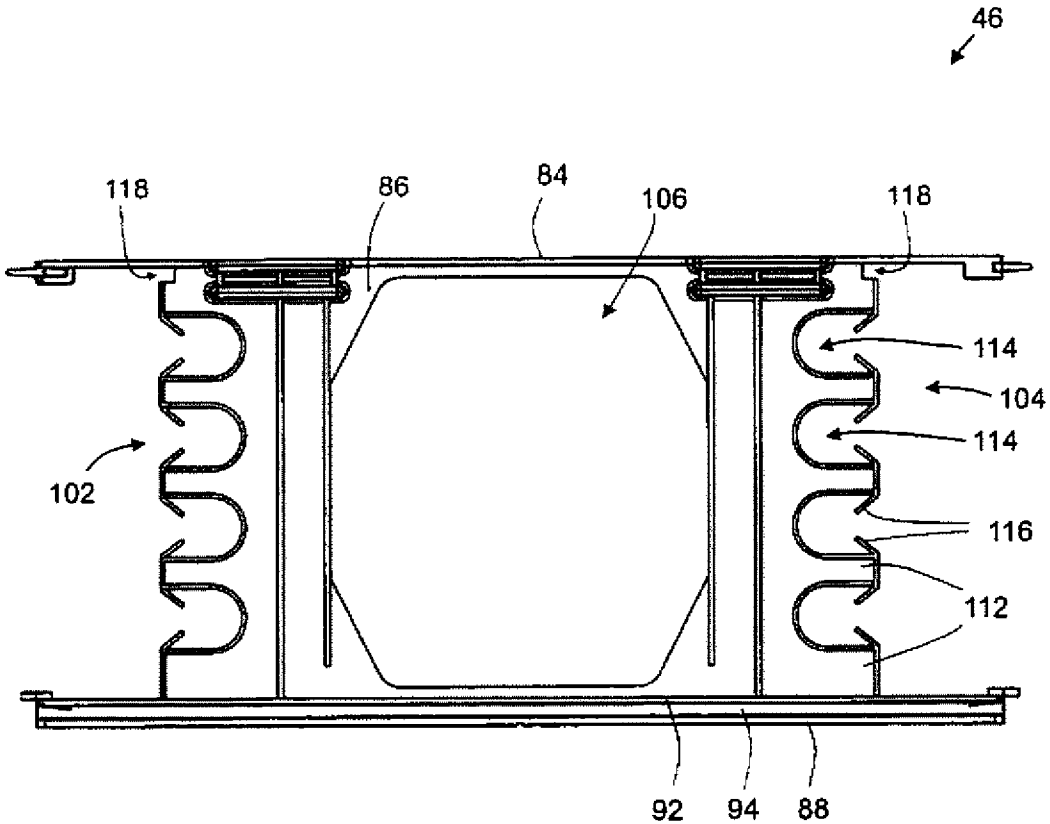
FIG. 10 is a side view of the tie member of FIG. 8.
Figure 12:
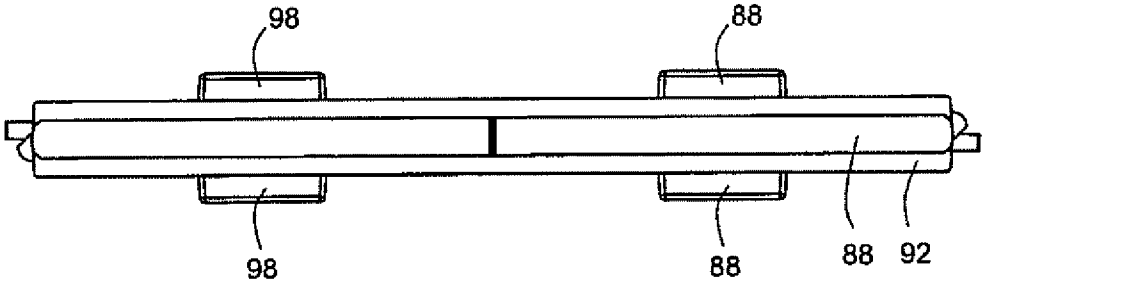
FIG. 12 is a rear view of the tie member of FIG. 8.
Figure 13:
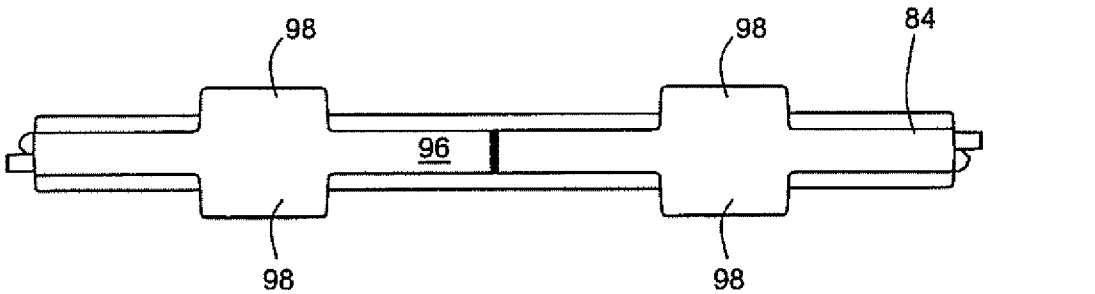
FIG. 13 is a front view of the tie member of FIG. 8.
Figure 15:
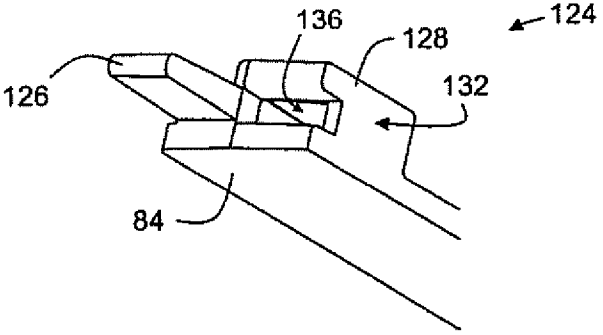
FIGS. 14 and 15 are enlarged fragmentary views of the tie member of FIG. 8 identified by reference numerals 14 and 15.
Figure 16:
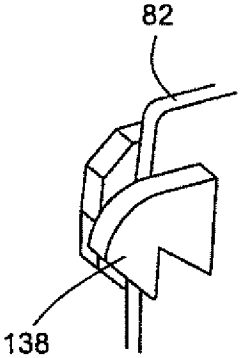
FIG. 16 is an enlarged fragmentary view of the tie member of FIG. 9 identified by reference numeral 16.
Figure 14:
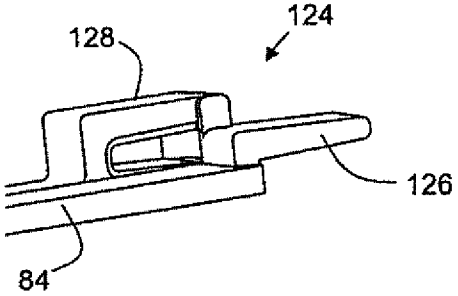

FIG. 2 shows one of the ties 40. Each tie 40 comprises a tie anchor 44 and a tie member 46, which are separately fabricated. The tie anchor 44 is configured to be embedded in a respective block 32 during fabrication of the block 32. The tie member 46 is configured to be connected to the embedded tie anchor 44 during assembly of the concrete formwork 30. The tie anchor 44 and the tie member 46 are each fabricated of a single piece of material, and in particular the tie anchor 44 and the tie member 46 are each fabricated of polyurethane by injection molding.

The tie anchor 44 may be better seen in FIGS. 3 to 7. In this embodiment, the tie anchor 44 comprises a longitudinal tab guide 52, a longitudinal anchor plate 54, and a web comprising a plurality of struts 56 connecting the tab guide 52 and the anchor plate 54. The tab guide 52 comprises a longitudinal base plate 58 from which a plurality of angled tabs 62 and 64 extend. The base plate 58 and the angled tabs 62 and 64 define a channel 70 that is sized to receive a portion of the tie member 46, for mating engagement of the tie anchor 44 and the tie member 46. In particular, the angled tabs comprise a first plurality of angled tabs 62 that extend from a first longitudinal edge of the base plate 58, and a second plurality of angled tabs 64 that extend from a second, opposite longitudinal edge of the base plate 58. In the example shown, the angled tabs 62 and 64 are arranged in an alternating pattern along the length of the base plate 58. Each longitudinal tab 62 and 64 comprises a first tab portion 72 joined to the base plate 58, and a second tab portion 74 extending from the first tab portion 72 in a direction parallel to the base plate 58 and toward the opposing angled tabs 62 or 64. The ends of the second tab portions 74 of angled tabs 62 and 64 are spaced from each other by a distance, d, so as to enable the channel 70 to be accessible from a concrete-facing surface of the block. The channel 70 has a first end 76 and a second end 78, each of which defines an opening of the channel 70 for allowing the tie member 46 to be slidably inserted.

Each strut 56 of the tie anchor web is in the form of a flat strip that is connected to the base plate 58 of the tab guide 52 and to the anchor plate 54. As will be understood, the flat shape of the strut 56 provides resistance to bending, and has a large interfacial area to provide better bonding between the tie anchor 44 and the material of the block 32 while utilizing less material, as compared to other shapes such as circular or square. The anchor plate 54 has a generally longitudinal, planar shape.

The tie member 46 may be better seen in FIGS. 8 to 16. In this embodiment, tie member 46 comprises a longitudinal rail 82, a longitudinal panel fastening plate 84, and a central web 86 connecting the rail 82 and the panel fastening plate 84. The rail 82 comprises a longitudinal tab 88 and a longitudinal base 92, which are connected by a longitudinal web 94 oriented orthogonally thereto. The longitudinal tab 88 is configured to be slidably inserted into the channel 70 of the tie anchor 44, for mating engagement of the tie anchor 44 and the tie member 46. The panel fastening plate 84 has an elongate panel fastening surface 96, to which a panel 34 is to be fastened during assembly of the concrete formwork 30. The panel fastening plate 84 comprises two (2) pairs of laterally extending flanges 98, with each flange 98 defining a portion of the fastening surface 96. As will be understood, the flanges 98 are configured to facilitate fastening of the panel 34 by providing a laterally enlarged area for fastening, and by impeding rotation of the tie member 46 relative to the panel 34. The web 86 is of generally planar shape, and has a first edge 102, a second edge 104, and a central aperture 106 therebetween. The web 86 comprises a plurality of fingers 112 that extend outwardly from each of the first edge 102 and the second edge 104. The fingers 112 define recesses 114 therebetween that are configured to accommodate reinforcement bar (not shown), also referred to as "rebar", that may be laid during assembly of the concrete form 30. Each finger 112 terminates in two (2) inwardly-extending hooks 116, which are configured to assist in retaining the reinforcement bar in the recesses 114 during assembly of the concrete form 30, and during pouring of concrete into the assembled concrete form 30. The web 86 has a notch 118 defined in each of the first edge 102 and the second edge 104 adjacent the panel fastening plate 84. The notch 118 is configured to engage a connecting rod 120, described below, for maintaining parallel alignment of adjacent tie members 46 during assembly of concrete formwork 30.

The tie member 46 also comprises a plurality of connectors for enabling vertically abutting tie members 46 to be connected. In the example shown, each tie member 46 comprises a first connector 124 at each end of the panel fastening plate 84. As will be understood, each first connector 124 is configured to engage the first connector 124 of a vertically abutting tie member 46. In the example shown, each first connector 124 comprises a longitudinally extending tongue 126, and an angled tab 128 and sidewall 132 defining a recess 136 sized to receive the tongue 126 of another connector 124. As will be understood, when vertically adjacent tie members 46 abut, the tongue 126 of one connector 124 is received in the recess 136 of another connector 124, and relative lateral movement of tie members 46 is prevented. Each tie member 46 also comprises a second connector 138 at each end of the longitudinal base 92 of the rail 82. The second connector 138 is configured to engage a second connector 138 of a vertically abutting tie member 46. In the example shown, each second connector 138 is in the form of a hook-shaped clip. As will be understood, when vertically adjacent tie members 46 abut, the second connector 138 of one tie member 46 engages the second connector 138 of another tie member 46, and relative vertical movement of the tie members 46 is prevented. Vertically abutting tie members 46, connected in this manner by connectors 124 and 138, yield columns 140 of connected tie members 46.

Figure 17:
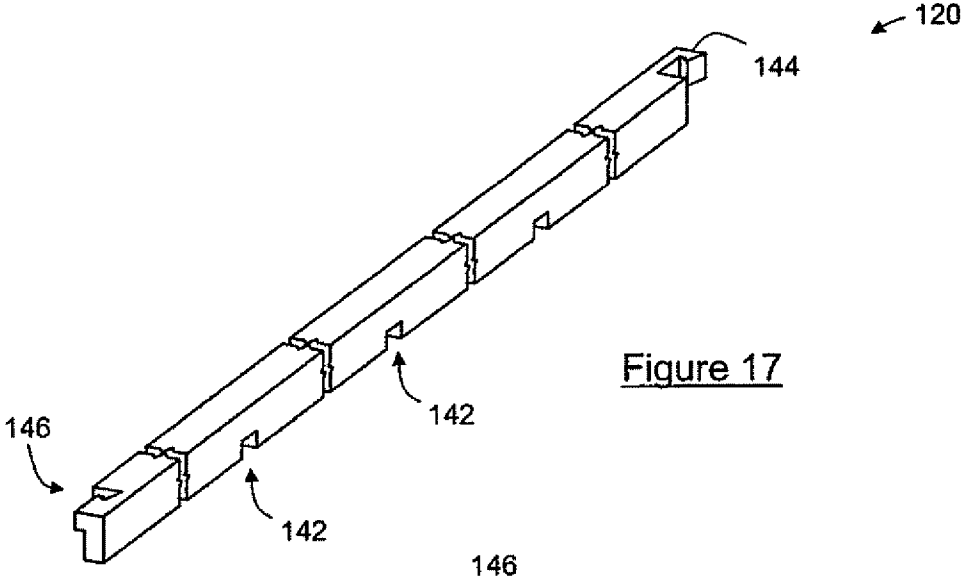
FIG. 17 is a perspective view of a connecting rod forming part of the concrete formwork of FIG. 1.
Figure 18:
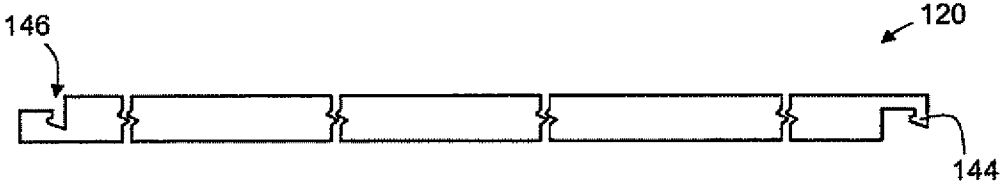
FIG. 18 is a top view of the connecting rod of FIG. 17.
Figure 19:
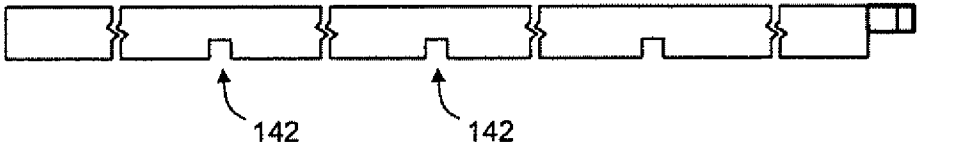
FIG. 19 is a front view of the connecting rod of FIG. 17.

FIGS. 17 to 19 show the connecting rod 120. In this embodiment, the connecting rod 120 is in the form of a longitudinal angled rod, and has a plurality of spaced notches 142 formed therein, with each notch 142 being configured to engage a respective notch 118 of a tie member 46. In the example shown, the connecting rod 120 has three (3) notches 142 formed therein. The connecting rod 120 has connecting portions at its ends for enabling adjacent connecting rods 120 to be connected. In the example shown, the connecting portions comprise a barbed clip 144 at a first end of the connecting rod 120, and a corresponding recess 146 at a second end of the connecting rod 120 shaped to receive a barbed clip 144 of another connecting rod 120. As will be understood, when the connecting rod 120 is seated on three (3) tie members 46 within concrete formwork 30 such that each notch 142 of the connecting rod 120 engages a notch 118 of a respective tie member 46, the connecting rod 120 links the free ends of the three (3) tie members 46 and maintains parallel alignment of the tie members 46, including the tie members 46 below and connected within columns 140, which facilitates fastening of the panels 34. Further, when adjacent connecting rods 120 are connected, the free ends of the tie members 46 of the plurality of columns 140 on which the connecting rods 120 are seated are linked.

Figure 21:
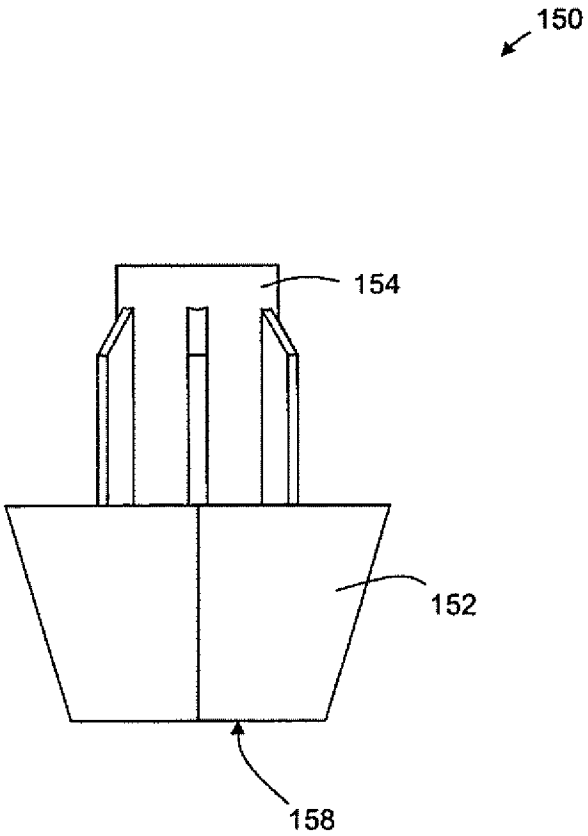
FIG. 21 is a side view of the spacer of FIG. 20.
Figure 20:
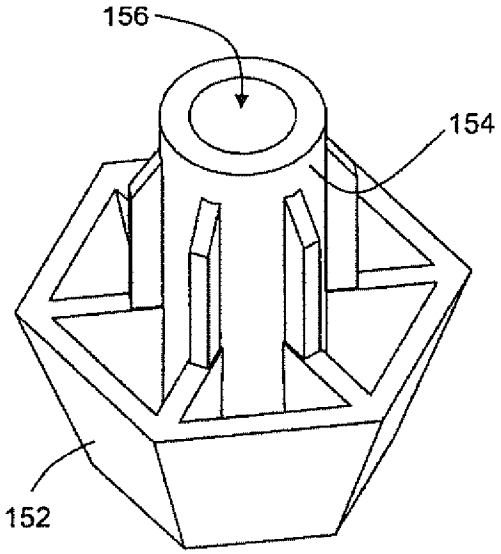
FIG. 20 is a perspective view of a spacer forming part of the concrete formwork of FIG. 1.

FIGS. 20 and 21 show a spacer for use with the concrete formwork 30, which is generally indicated by reference numeral 150. Spacer 150 comprises a tapered body 152 and a hollow, splined shaft 154 extending therefrom. A bore 156 for accommodating a fastener extends through the body 152 and the shaft 154. The body 152 has a flat surface 158 on an end thereof for abutting the fastening surface 96 of the tie member 46. As will be understood, the splined shaft 154 is configured to be embedded in the panel 34, such that when the spacer is embedded in this manner the thickness of the body 152 defines a fixed space between the concrete-facing surface of the panel 34 and the tie member 46.

Figure 22A:
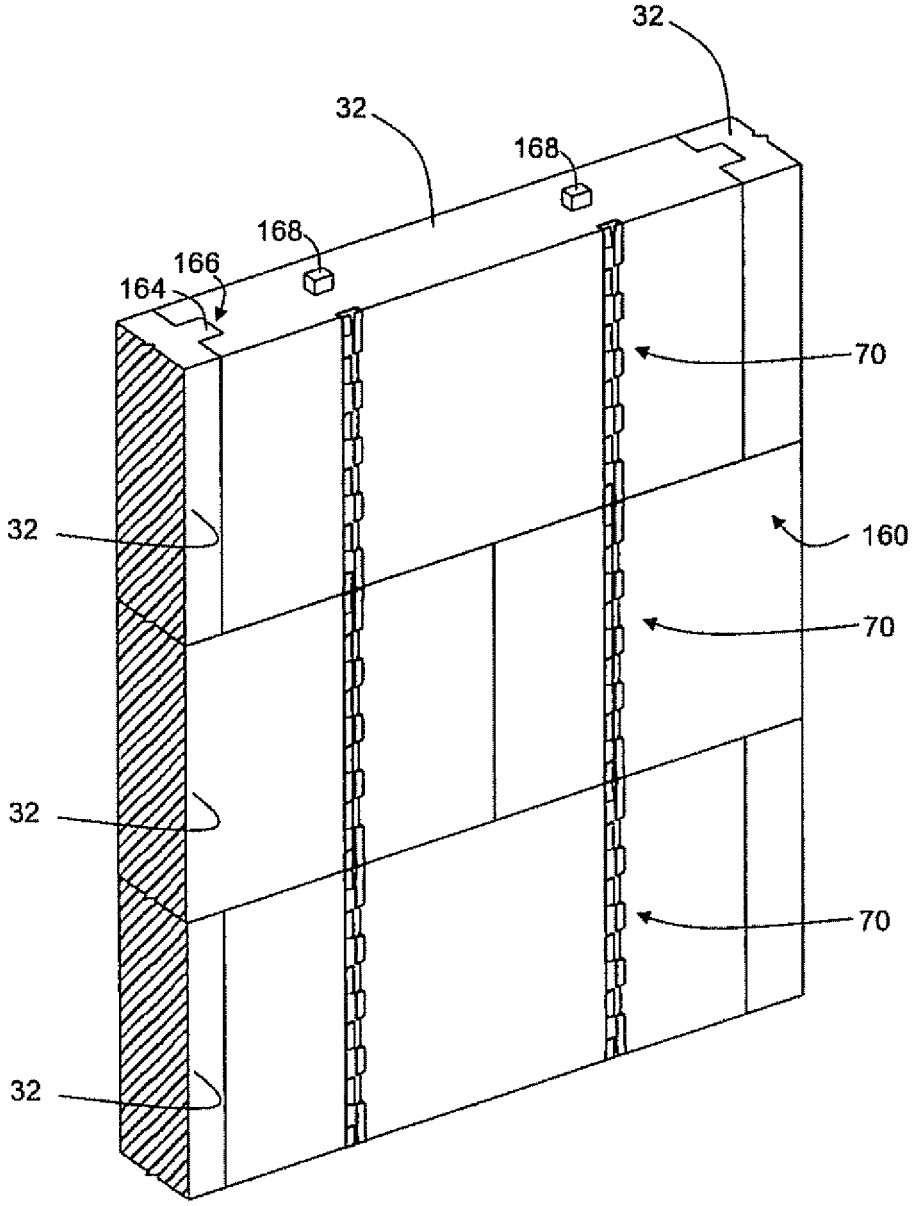
FIGS. 22A to 22C are views of the concrete formwork of FIG. 1, at various stages of assembly.
Figure 22B:
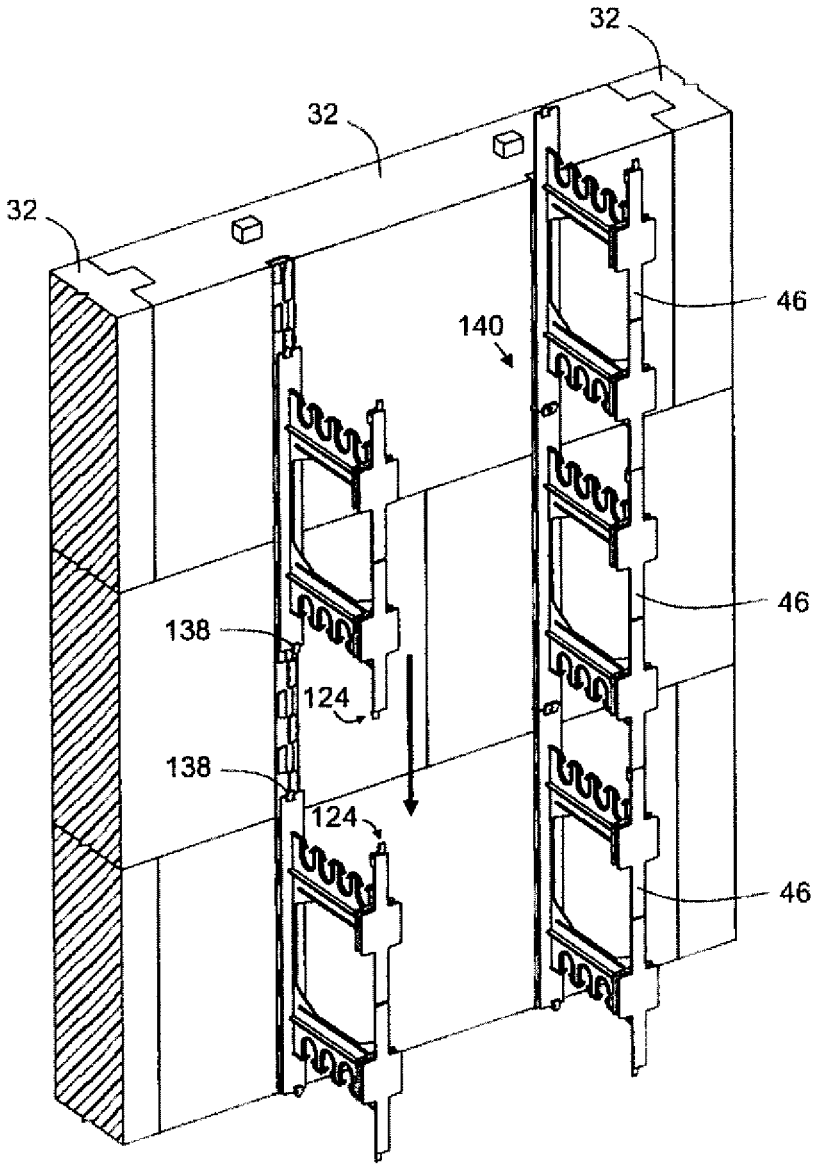
Figure 22C:
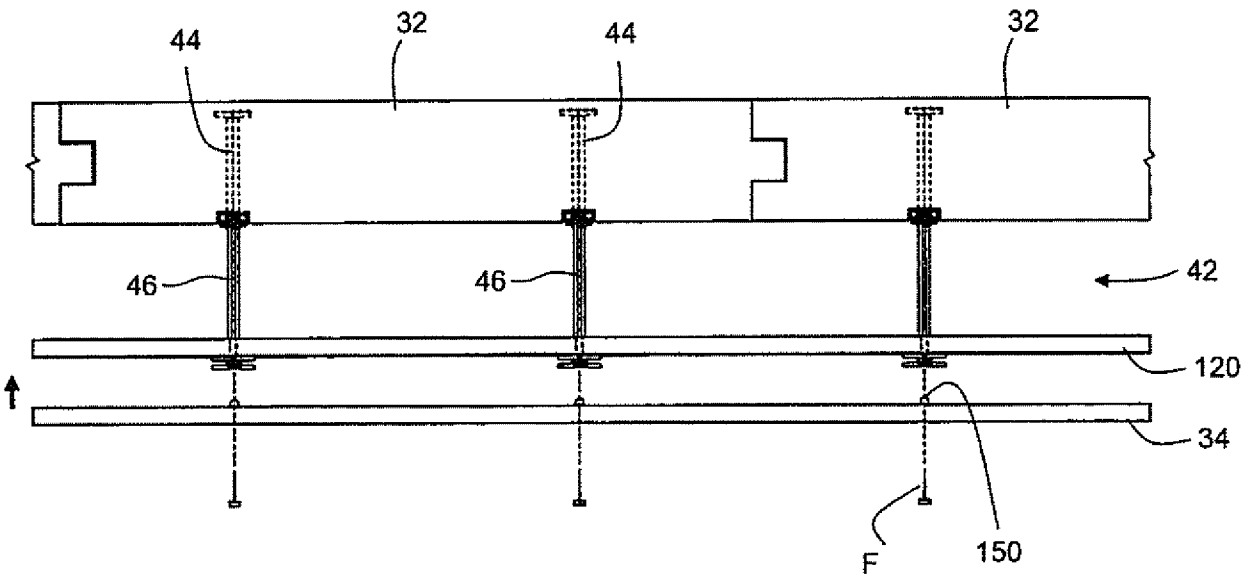

During fabrication of the block 32, a mold (not shown) of a molding machine (not shown) is filled at least partially with EPS particles, commonly referred to in the art as EPS "beads". Prior to introducing the EPS particles, the tie anchors 44 are positioned in the mold such that the tie anchors 44 become embedded at a desired position within the fabricated block 32. In particular, the tie anchors 44 are positioned such that outer surfaces of the second tab portions 74 of the angled tabs 62 and 64 are flush with a concrete-facing surface 160 of the fabricated block 32, such that channel 70 is accessible from the concrete-facing surface 160 of the fabricated block 32, and such that at least one of the first end 76 and the second end 78 of the channel 70 is accessible from an adjacent surface of the fabricated block 32, as shown for example in FIGS. 1 and 22A. Additionally, each tie anchor 44 is positioned in the mold such that the free surfaces of the anchor plate 54 and the struts 56 are surrounded by the material of the fabricated block 32, and are thereby encapsulated within the fabricated block 32.

With the tie anchors 44 and the EPS particles in the mold, the molding machine is configured to apply heat to the mold, such as for example by passing hot air or steam through the mold, so as to heat the EPS particles to above their melting point. The applied heat causes the EPS particles therein to form a continuous foam body (not shown) in which the tie anchors 44 are embedded.

Each block 32 has interlocking features that enable it to be fitted with other blocks 32 during assembly of the concrete formwork 30. In the example shown in FIG. 1 and FIGS. 22A to 22C, each block 32 has a tongue 164 formed on a first side, and a groove 166 formed in a second, opposing side. As will be understood, the tongue 164 and the groove 166 enable horizontally abutting blocks 32 to engage each other in an end-to-end manner, for extending the length of the concrete form 30. Additionally, in the example shown, each block 32 has two (2) pedestals 168 formed on a top side, and two (2) corresponding recesses (not shown) formed on a bottom side. As will be understood, the pedestals 168 and the recesses enable blocks 32 to be stacked in a staggered, "brickwork" like manner as shown in FIG. 1, for extending the height of the concrete form 30. When the blocks 32 are stacked in this manner, the channels 70 of the stacked blocks 32 are aligned, as shown for example in FIGS. 1 and 22A.

In use, the concrete formwork 30 is assembled by arranging a plurality of blocks 32 end-to-end such that tongues 164 engage grooves 166 of horizontally abutting blocks, and by stacking the blocks 32 in a staggered manner such that pedestals 168 engage recesses of vertically abutting blocks 32. Tie members 46 are then slideably inserted into the channels of the tie anchors 44, to connect the tie members 46 and the tie anchors 44. Vertically abutting tie members 46 are connected using first connectors 124 by inserting the tongues 126 into the recesses 136, and by engaging the second connectors 138 to yield columns 140 of connected tie members 46. A connecting rod 120 is then seated on three (3) horizontally adjacent tie members 46, such that the notches 142 of the connecting rod 120 engage the notches 118 of the tie members 46. With the connecting rod 120 positioned in this manner, the horizontally adjacent tie members 46, and the tie members 46 below and connected within columns 140, are linked, as shown in FIG. 1.

Figure 23:
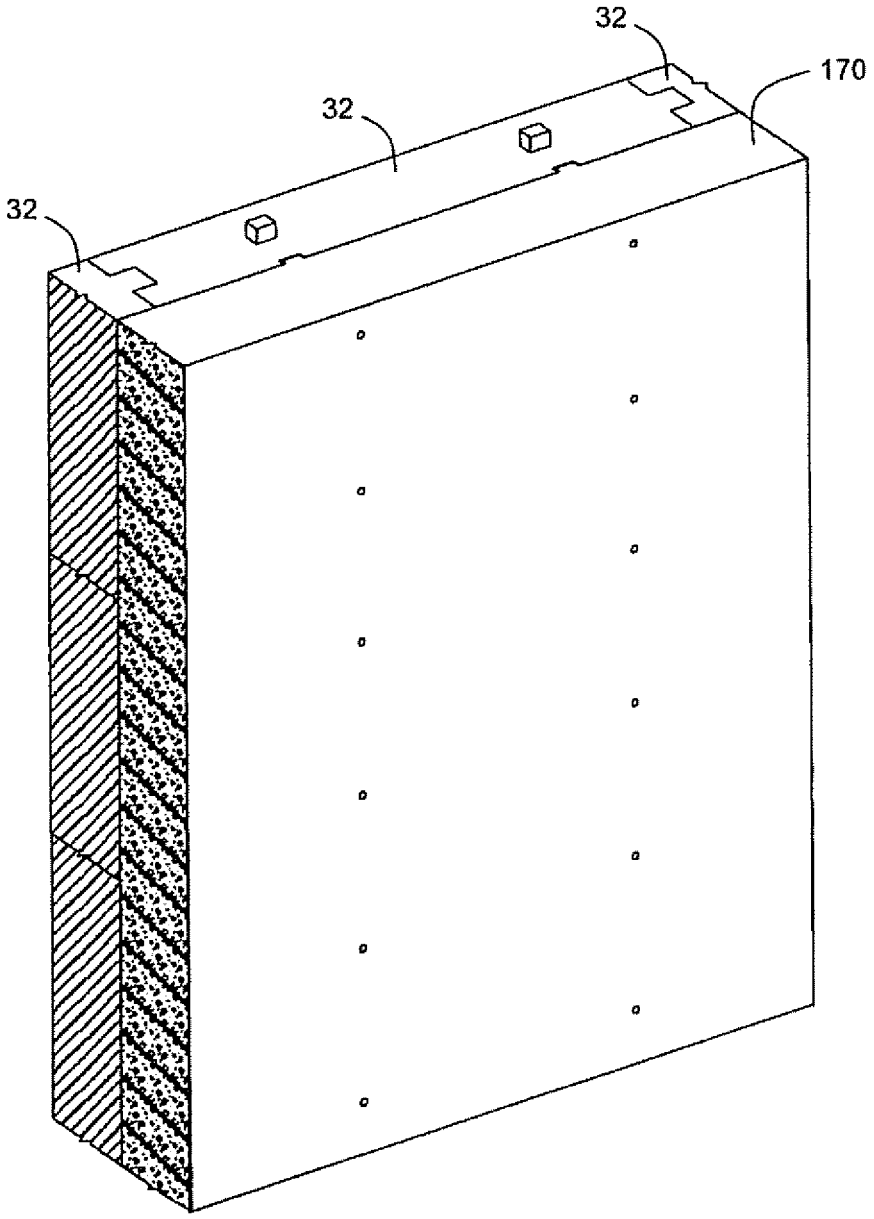
FIG. 23 is a perspective view of a concrete wall formed using the concrete formwork of FIG. 1.

Spacers 150 are then embedded into the panels 34, and the panels 34 are fastened to the fastening plates 74 of the tie members 46 using fasteners F, which in the example shown are screws. With the panels 34 fastened to the tie members 46, the blocks 32 and the panels 34 define the volume 42 into which concrete is to be poured to form the wall. Reinforcement bar may be laid in the recesses 114 of the webs 86 of the tie members 46 prior to pouring of the concrete. Concrete is then poured into the volume 42, and is allowed to set. Once the concrete has set, concrete wall 170 is formed. The panels 34 may then be removed, exposing an interior surface of the concrete wall 170 on which the spacers 150 are visible, as shown in FIG. 23. As will be understood, the fixed space defined by the bodies 152 of the spacers 150 between the panel 34 and the tie member 46 is filled with concrete. This ensures that no portion of tie member 46 is exposed on the interior surface of the concrete wall 170, and thereby enables the concrete wall 170 to comply with fire safety regulations.

Figure 24B:
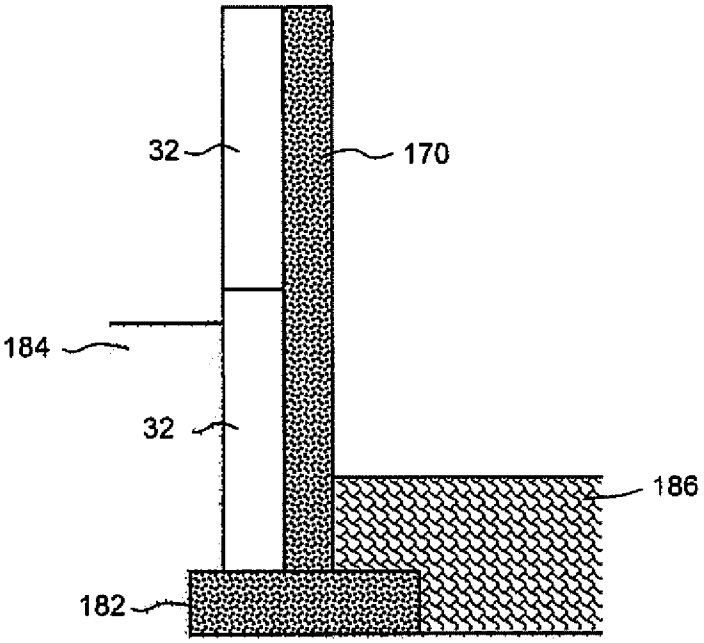
FIGS. 24A to 24D are elevational views of a concrete floor slab, at various stages of assembly.
Figure 24A:
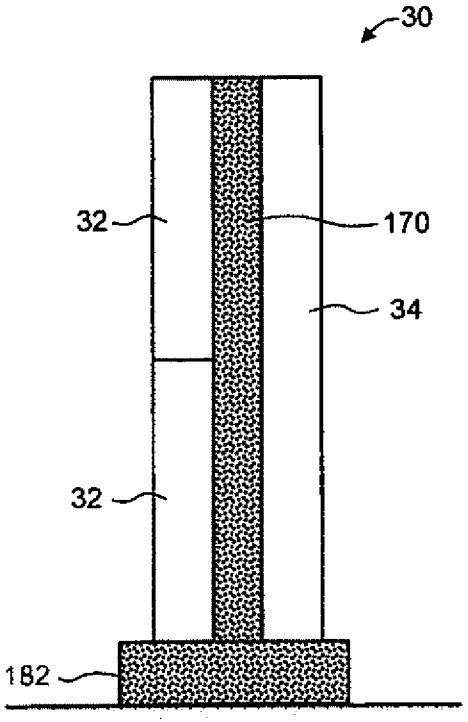
Figure 24D:
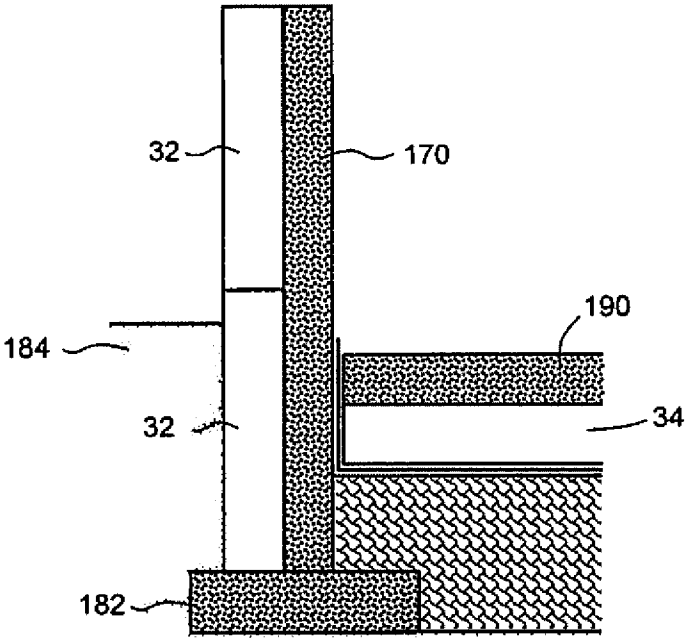
Figure 24C:
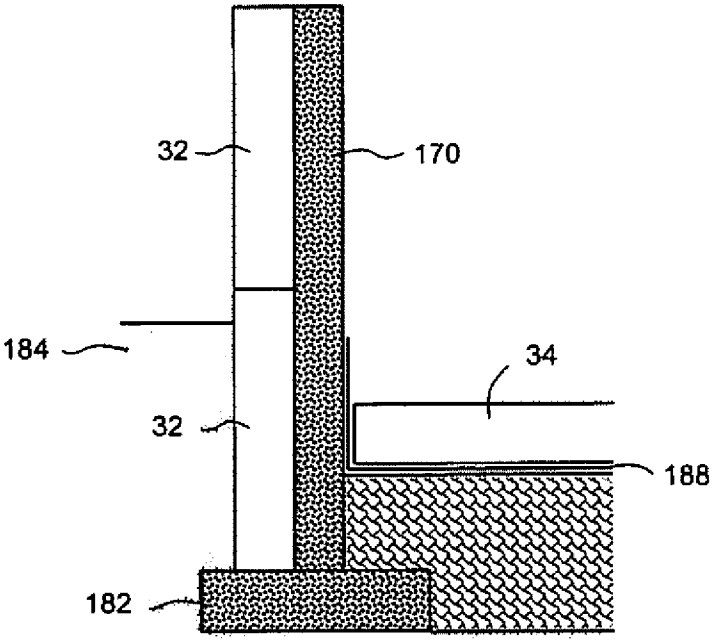

If the panels 34 are expanded polystyrene (EPS) foam panels, the removed panels 34 can be reused as an insulating layer during subsequent construction of a concrete floor slab. For example, FIGS. 24A to 24D show formation of a concrete floor slab after formation of the concrete wall. In the example shown, the concrete wall 170 is a concrete foundation wall formed on a concrete footing 182 using the concrete formwork 30. Once the concrete has set, the concrete wall 170 is formed, as shown in FIG. 24A. The panels 34 are then removed. Backfill 184 is added to an exterior side of the concrete wall 170, and fill in the form of a gravel bed 186 is added to an interior side of the concrete wall 170 above the concrete footing 182, as shown in FIG. 24B. A vapour barrier 188 is then laid on the gravel bed 186 and against a lower portion of the concrete wall 170, and the panels 34 are laid on the vapour barrier 188, as shown in FIG. 24C. Concrete is then poured onto the panels 34, and once the concrete has set the concrete floor slab 190 is formed, as shown in FIG. 24D.

As will be appreciated, the flanges 98 of the tie members 46 are configured to facilitate fastening of the panel 34 by providing a laterally enlarged area for fastening, and by impeding rotation of the tie member 46 relative to the panel 34 during fastening. As will be understood, this advantageously allows the panels 34 to be fastened more easily by workers at the construction site, and advantageously allows to the panels 34 to be fastened to the tie members 46 in a perpendicular manner more quickly, as compared to prior art tie members forming part of prior art concrete form ties.

As will be appreciated, the first connectors 124 of the tie members 46 enable the free ends (i.e. the ends of the tie members 46 distal from the tie anchors 44) of vertically abutting tie members 46 to be connected, which prevents relative lateral movement of the members 46. As will be understood, this connection unifies the panel fastening surfaces 96 of the tie members 46 within the columns 140, which advantageously allows the panels 34 to be fastened more easily by workers at the construction site, and advantageously allows to the panels 34 to be fastened to the tie members 46 in a perpendicular manner more quickly, as compared to prior art tie members forming part of prior art concrete form ties.

As will be appreciated, when the connecting rod 120 is seated on three (3) tie members 46 within the concrete formwork 30, the connecting rod 120 links the free ends of the three (3) tie members 46, and the tie members 46 below and connected within columns 140, and maintains parallel alignment of the tie members 46 of the linked columns 140. As will be understood, this alignment advantageously ensures that the panel fastening surfaces 96 of i) the tie members 46 on which the connecting rod 120 is seated and ii) the tie members 46 below and connected within columns 140, are all parallel. As will be understood, this parallel alignment of all panel fastening surfaces 96 advantageously allows the panels 34 to be fastened more easily by workers at the construction site, and advantageously allows to the panels 34 to be fastened to the tie members 46 in a perpendicular manner more quickly, as compared to prior art tie members forming part of prior art concrete form ties.

Figure 25:
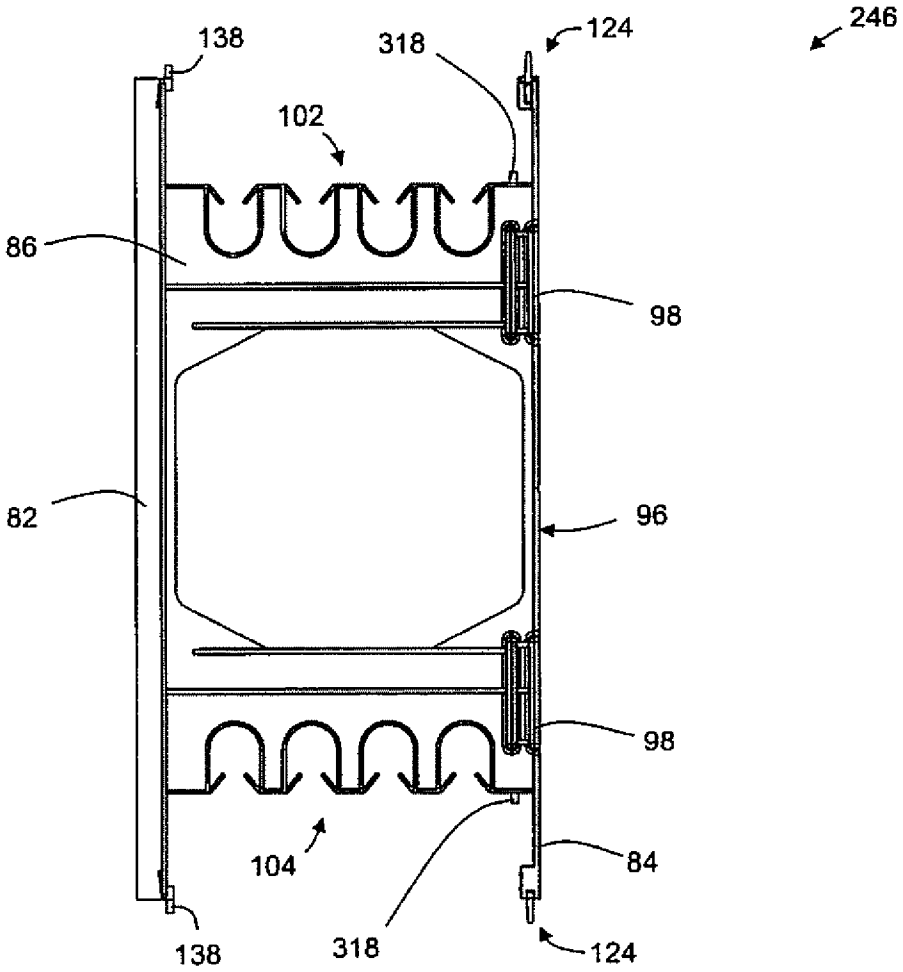
FIG. 25 is a side view another embodiment of a tie member forming part of the concrete formwork of FIG. 1.

The concrete formwork 30 and components thereof are not limited to the configuration described above, and in other embodiments, other configurations are possible. For example, FIG. 25 shows another embodiment of a tie member for use with the concrete formwork 30, and which is generally indicated by reference numeral 246. Tie member 246 is generally identical to tie member 46 described above and with reference to FIGS. 8 to 16, and comprises the longitudinal rail 82, the longitudinal panel fastening plate 84, and the central web 86 connecting the rail 82 and the panel fastening plate 84. The panel fastening plate 84 has the elongate panel fastening surface 96, to which the panel 34 is to be fastened during assembly of the concrete formwork 30, and the panel fastening plate 84 comprises two (2) pairs of the laterally extending flanges 98 each defining a portion of the fastening surface 96. The web 86 has the first edge 102, the second edge 104, and the central aperture therebetween. In this embodiment, the web 86 has a pin 318 formed in each of the first edge 102 and the second edge 104 adjacent the panel fastening plate 84. The pin 318 is configured to engage a connecting rod 320, described below, for maintaining parallel alignment of adjacent tie members 246 during assembly of concrete formwork 30.

Similar to tie member 46, the tie member 246 also comprises the plurality of connectors for enabling vertically abutting tie members 246 to be connected. Each tie member 246 comprises the first connector 124 at each end of the panel fastening plate 84, and the second connector 138 at each end of the longitudinal base 92 of the rail 82.

Figure 26:
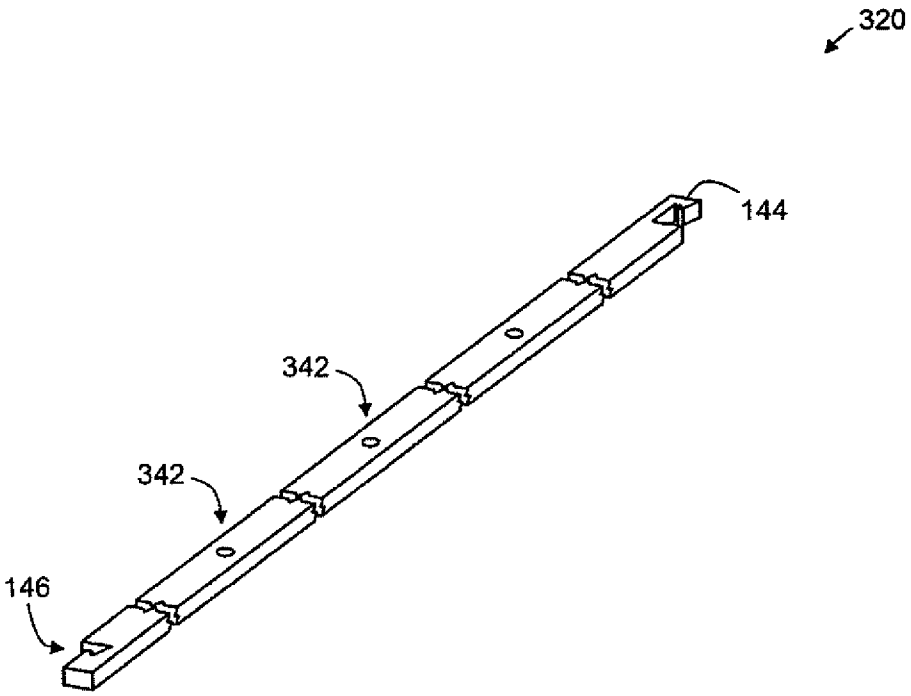
FIG. 26 is a perspective view of another embodiment of a connecting rod forming part of the concrete formwork of FIG. 1.

FIG. 26 shows the connecting rod 320. Connecting rod 320 is similar to connecting rod 120 described above and with reference to FIGS. 17 to 19, but is in the form of a longitudinal strip comprising a plurality of bores 342 formed therein and extending through the thickness of the strip. Each bore 342 is configured to receive a respective pin 318 of a tie member 246. In the example shown, the connecting rod 320 has three (3) bores 342 formed therein. The connecting rod 320 has connecting portions at its ends for enabling adjacent connecting rods 320 to be connected, and in the example shown the connecting portions comprise the barbed clip 144 and the recess 146. As will be understood, when the connecting rod 320 is seated on three (3) tie members 246 within concrete formwork 30 such that each bore 342 of the connecting rod 320 receives a pin 318 of a respective tie member 246, the connecting rod 320 links the free ends of the three (3) tie members 246 and maintains parallel alignment of the tie members 246, and including the tie members 246 below and connected within columns 140, which facilitates fastening of the panels 34. Further, when adjacent connecting rods 320 seated on tie members 246 are connected, the free ends of the tie members 246 of the plurality of columns 140 on which the connecting rods 320 are seated are linked.

Figure 27A:
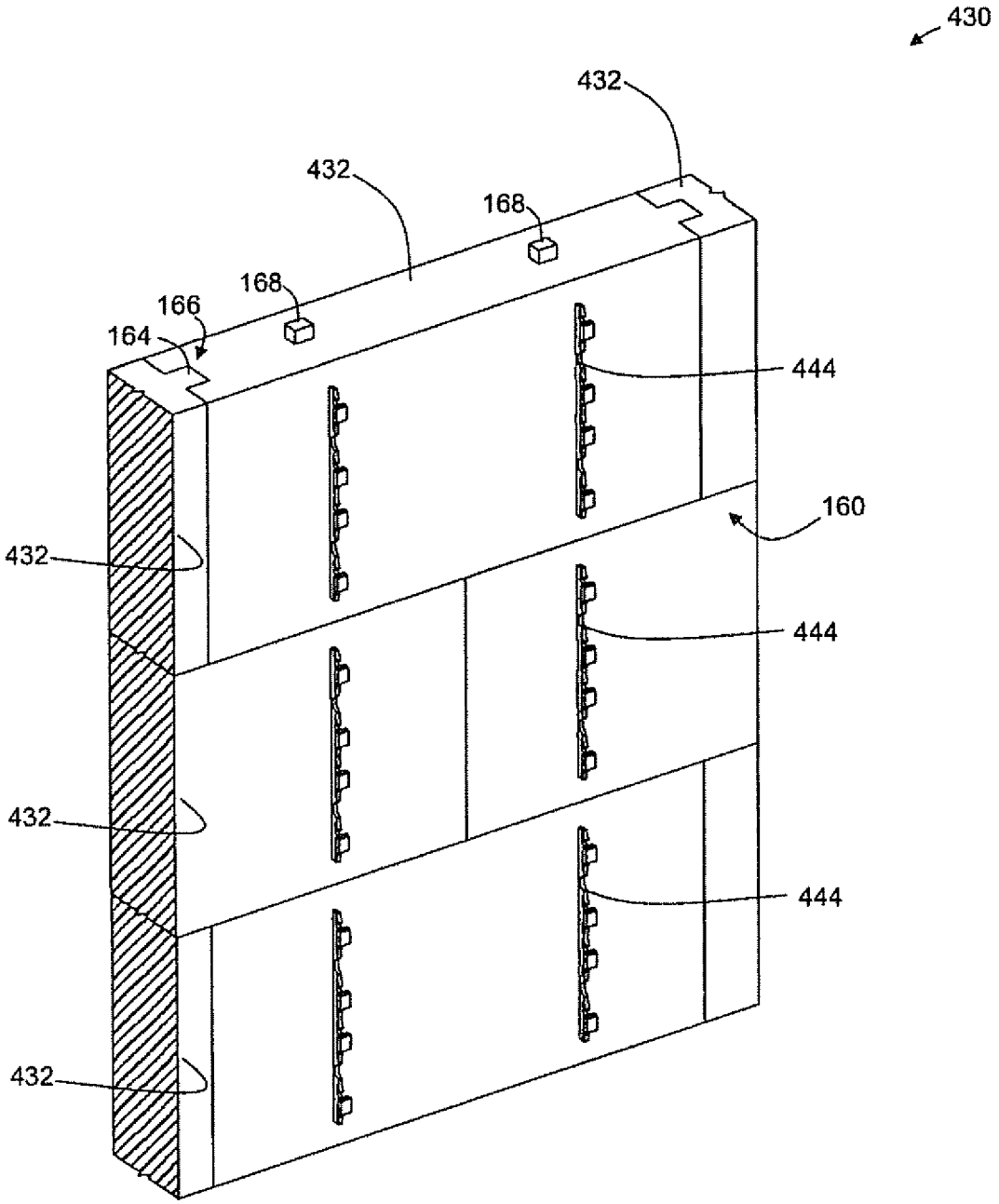
FIGS. 27A and 27B are perspective views of another embodiment of a concrete formwork, at various stages of partial assembly.
Figure 27B:
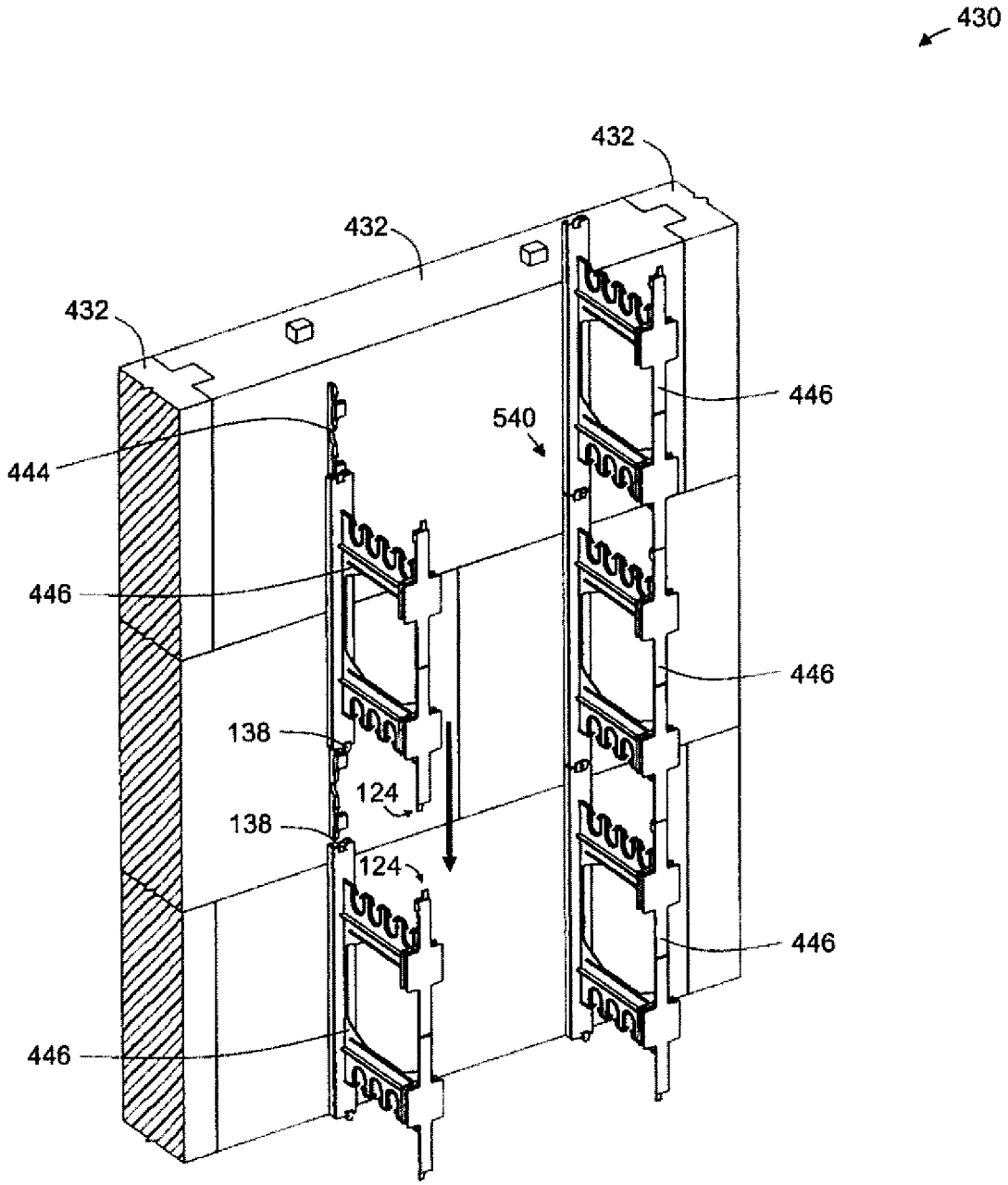

Still other configurations are possible. For example, FIGS. 27A and 27B show a portion of a partially assembled concrete formwork in various stages of assembly, which is generally indicated by reference numeral 430. Concrete formwork 430 is generally similar to concrete formwork 30 described above, and is configured to serve as a mold into which concrete (not shown) is poured to form a concrete wall during construction of a building. The building may be a residential building, such as a house, and the concrete wall may be a concrete foundation wall, for example.

Concrete formwork 430 comprises a plurality of blocks 432 fabricated of an insulating material, the plurality of panels 34, and a plurality of ties connecting the blocks 432 and the panels 34. When connected by the ties, the blocks 432 and the panels 34 define the volume into which the concrete is to be poured. In this embodiment, each block 432 is fabricated of expanded polystyrene (EPS) foam by molding.

Each tie comprises a tie anchor 444 and a tie member 446, which are separately fabricated. The tie anchor 444 is configured to be embedded in a respective block 432 during fabrication of the block 432. The tie member 446 is configured to be connected to the embedded tie anchor 444 during assembly of the concrete formwork 430. The tie anchor 444 and the tie member 446 are each fabricated of a single piece of material, and in particular the tie anchor 444 and the tie member 446 are each fabricated of polyurethane by injection molding.

Figure 28:
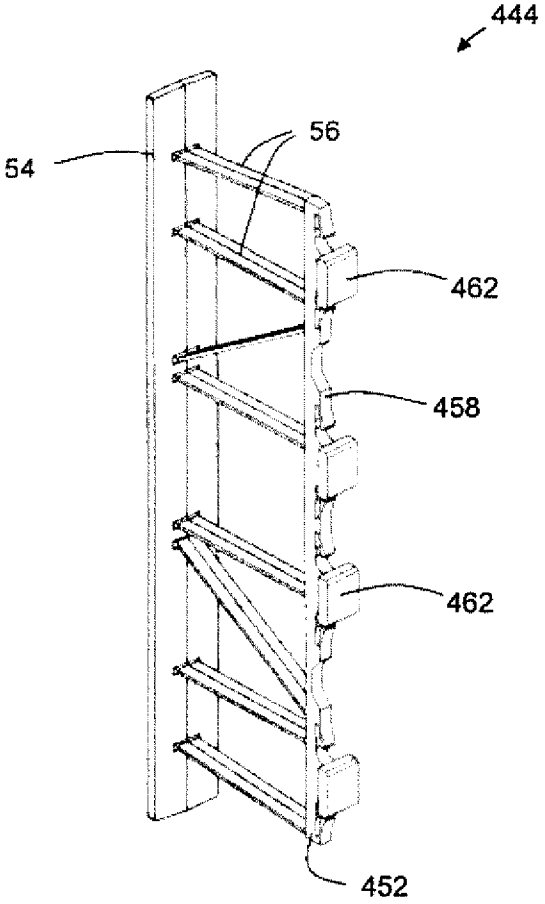
FIG. 28 is a perspective view of another embodiment of a tie anchor, forming part of the concrete formwork of FIGS. 27A and 27B.

The tie anchor 444 may be better seen in FIG. 28. The tie anchor 444 is similar to tie anchor 44 described above and with reference to FIGS. 3 to 7, but in this embodiment the tie anchor comprises a longitudinal connector strip 452, the longitudinal anchor plate 54, and the web comprising the plurality of struts 56 connecting the connector strip 452 and the anchor plate 54. The connector strip 452 comprises a longitudinal rib 458 having a series of spaced knobs 462 formed thereon. The spaced knobs 462 and a portion of the longitudinal rib 458 are configured to be slidably received in a longitudinal slot of the tie member 446, for mating engagement of the tie anchor 444 and the tie member 446.

Figure 29:
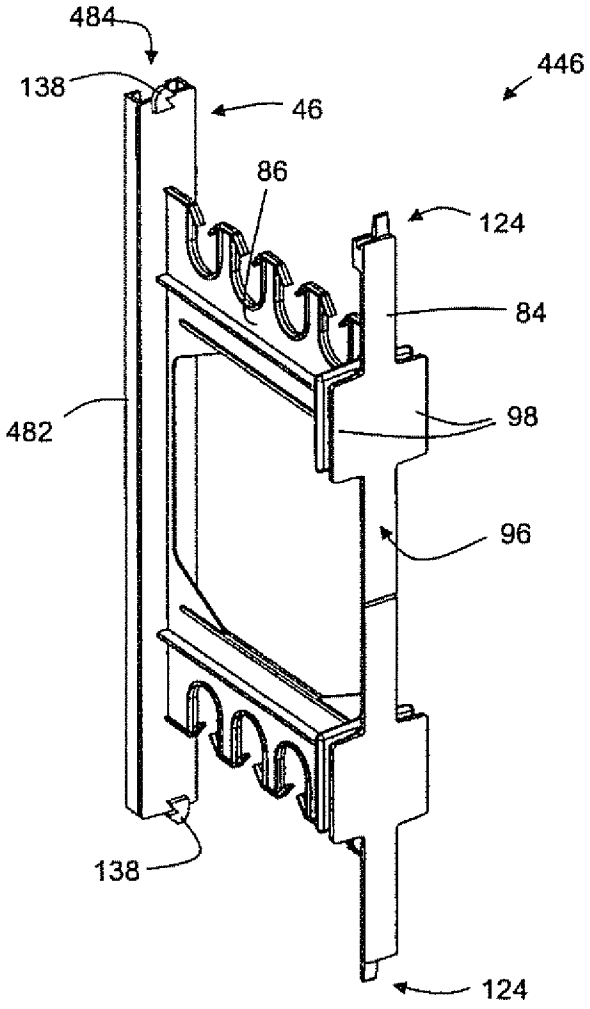
FIG. 29 is a perspective view of another embodiment of a tie member, forming part of the concrete formwork of FIGS. 27A and 27B.

The tie member 446 may be better seen in FIG. 29. The tie member 446 is similar to tie anchor 44 described above and with reference to FIGS. 8 to 16, but in this embodiment the tie member comprises a longitudinal guide 482, the longitudinal panel fastening plate 84, and the central web 86 connecting the guide 482 and the panel fastening plate 84. The longitudinal guide 482 has a generally "C-shaped" section along its length, and defines a longitudinal channel 484 that is sized to accommodate the knobs 462 and a portion of the longitudinal rib 458 of the tie anchor 444. The "C-shaped" guide 482 has longitudinal opening that extends its length, and which is configured to accommodate the longitudinal rib 458 when the tie anchor 444 and the tie member 446 are matingly engaged.

The tie member 446 also comprises a plurality of connectors for enabling vertically abutting tie members 446 to be connected. In the example shown, each tie member 446 comprises the first connector 124 at each end of the panel fastening plate 84. As discussed above for tie member 46, when vertically adjacent tie members 446 abut, the tongue 126 of one connector 124 is received in the recess 136 of another connector 124, and relative lateral movement of tie members 446 is prevented. Each tie member 446 also comprises the second connector 138 at each end of the longitudinal guide 482. The second connector 138 is configured to engage a second connector 138 of a vertically abutting tie member 46. In the example shown, each second connector 138 is in the form of the hook-shaped clip. As will be understood, when vertically adjacent tie members 46 abut, the second connector 138 of one tie member 46 engages the second connector 138 of another tie member 46, and relative vertical movement of the tie members 46 is prevented. Vertically abutting tie members 446, connected in this manner by connectors 124 and 138, yield columns 540 of connected tie members 446.

Although in the embodiments described above, the panels are fabricated of EPS foam, or of a rigid sheet material such as plywood, oriented strand board (OSB), and the like, in other embodiments, the panels may alternatively be fabricated of other suitable foam materials, such as for example extruded polystyrene (XPS) foam, or of other suitable rigid sheet materials, such as for example drywall. Still other materials or combinations of materials may alternatively be used.

Although in the embodiments described above, each of the tie anchor and the tie member is fabricated of a single piece of material, in other embodiments, one or both of the tie anchor and the tie member may alternatively be fabricated of more than one (1) piece of material.

Although in the embodiments described above, each of the tie anchor and the tie member is fabricated of polyurethane by injection molding, in other embodiments, one or both of the tie anchor and the tie member may alternatively be fabricated of another material, and/or by another suitable fabrication method.

Although in the embodiments described above, the tie anchor comprises a web comprising a plurality of struts, in other embodiments, the tie anchor may alternatively comprise a web having a different configuration, such as a web having a generally planar shape and comprising a central aperture. Still other configurations are possible.

Although in an embodiment described above, the tie anchor comprises the guide comprising the base plate and the angled tabs which define a channel that is sized to receive the portion of the tie member, in other embodiments, the tie anchor may alternatively comprise other features that define a channel that is sized to receive the portion of the tie member.

Although in an embodiment described above, the tie anchor comprises a longitudinal rib having a series of spaced knobs formed thereon, in other embodiments, the tie anchor may alternatively be comprise another configuration configured to be slideably received in the longitudinal slot of the tie member. For example, in one such embodiment, the tie anchor may alternatively comprise a longitudinal rib having a longitudinal tab or rail formed thereon. Other configurations are possible.

Although in an embodiment described above, the tie member comprises a longitudinal guide having a generally "C-shaped" section along its length and defining a longitudinal channel that is sized to accommodate a portion of the tie anchor, in other embodiments, the tie member may alternatively be comprise another configuration configured to accommodate a portion of the tie anchor. For example, in one such embodiment, the tie member may alternatively comprise a series of angled tabs extending from a longitudinal baseplate, which define a channel that is sized to accommodate a portion of the tie anchor. Other configurations are possible.

Although in the embodiments described above, the tie member has a panel fastening plate comprising two (2) pairs of laterally extending flanges, in other embodiments, the tie member may alternatively have a panel fastening plate comprising one (1) pair, or greater than two (2) pairs, of laterally extending flanges, with each flange defining a portion of the fastening surface.

Although in an embodiment described above, the connecting rod is in the form of a longitudinal angled rod, in other embodiments, the connecting rod may alternatively be in another form, such as in the form of a notched strip, for example.

Although in the embodiments described above, the concrete formwork comprises a connecting rod having linking features, in other embodiments, the concrete formwork may alternatively comprise a generic rod such as a length of reinforcement bar ("rebar"), or other rod or length or strip of material, and each tie member may alternatively have a clip for securing the rod to the tie member. In still other embodiments, the connecting rod may alternatively comprise clips, with each clip being securable to a respective tie member.

Although in the embodiments described above, each block has interlocking features comprising a tongue formed on a first side, and a groove formed in a second, opposing side for enabling horizontally abutting blocks to engage each other in an end-to-to end manner, in other embodiments, each block may alternatively have other provisions for enabling adjacent blocks to engage each other in an end-to-end manner. Similarly, although in the embodiments described above, each block has interlocking features comprising two (2) pedestals formed on a top side, and two (2) corresponding recesses formed on a bottom side for enabling blocks to be stacked, in other embodiments, each block may alternatively have other provisions for enabling blocks to be stacked.

Although in the embodiments described above, the concrete formwork comprises spacers embedded in the panel such that each spacer creates a fixed space between the concrete-facing surface of the panel and the tie member, in other embodiments, the concrete formwork may alternatively comprise spacers not embedded in the panel but rather inserted between the panel and the tie member, which may optionally held in place by the fasteners. In still other embodiments, the concrete formwork may alternatively comprise no spacers between the concrete-facing surface of the panel and the tie member.

Although embodiments have been described above with reference to the accompanying drawings, those of skill in the art will appreciate that variations and modifications may be made without departing from the scope thereof as defined by the appended claims.

What is claimed is:

1. A tie for a concrete formwork, the tie comprising:

a tie anchor configured to be embedded in a block of insulating material, the tie anchor having a first connecting feature accessible from a concrete-facing surface of the block; and a tie member fabricated of a single piece of material, comprising:

a second connecting feature shaped to slidably engage the first connecting feature in a direction along a length of the tie anchor to connect to the first connecting feature of the tie anchor, a panel fastening plate defining an elongate panel fastening surface, a central web connecting the second connecting feature and the panel fastening plate, and at least one connector for connecting to an abutting tie member.

2. The tie of claim 1, further comprising flanges extending laterally from the panel fastening plate and defining a portion of the panel fastening surface.

3. The tie of claim 1, wherein the panel fastening surface extends the length of the panel fastening plate.

4. The tie of claim 1, wherein the web has a linking feature formed in an edge thereof, the linking feature being sized to engage a connecting rod for linking the tie member to an adjacent tie member.

5. The tie of claim 4, wherein the linking feature is a notch formed in the edge of the web, the notch being sized to receive the connecting rod.

6. The tie of claim 4, wherein the linking feature is a pin formed in the edge of the web, the pin being sized to engage a bore formed in the connecting rod.

7. The tie of claim 1, wherein the at least one connector comprises a connector at each longitudinal end of the panel fastening plate.

8. The tie of claim 1, wherein the at least one connector comprises a connector at each end of the second connecting feature for connecting to said abutting tie member.

9. The tie of claim 1 used in a concrete formwork that includes a plurality of blocks of insulating material arranged to define a side of the formwork, each block comprising at least two tie anchors embedded therein, each tie anchor having the first connecting feature accessible from a concrete-facing surface of the block;

at least two tie members, each tie member having a second connecting feature connected to the first connecting feature of a respective one of the tie anchors;

a connecting rod seated horizontally on two or more adjacent tie members, the connecting rod linking the two or more tie members; and a panel fastened to the tie members, the panel and the blocks defining a volume into which concrete is to be poured.

10. The concrete formwork of claim 9, wherein the panel is spaced from ends of the tie members by a plurality of spacers.

11. The concrete formwork of claim 10, wherein the panel is fastened to the tie members by fasteners extending through the spacers.

12. The concrete formwork of claim 9, wherein each tie member has at least one connector for connecting to a vertically abutting tie member.

13. The concrete formwork of claim 12, wherein each tie member further comprises:

a panel fastening plate defining an elongate panel fastening surface; and a central web connecting the panel fastening plate and the second connecting feature.

14. The concrete formwork of claim 13, further comprising flanges extending laterally from the longitudinal panel fastening plate and defining a portion of the panel fastening surface.

15. The concrete formwork of claim 13, wherein the web has a linking feature formed in an edge thereof, the linking feature being sized to engage the connecting rod.

16. The concrete formwork of claim 15, wherein the linking feature is:

a notch formed in the edge of the web, the notch being sized to receive the connecting rod, or a pin formed in the edge of the web, the pin being sized to engage a bore formed in the connecting rod.

* * * * *